US010500473B2

(12) United States Patent
Watterson

(10) Patent No.: US 10,500,473 B2
(45) Date of Patent: Dec. 10, 2019

(54) CONSOLE POSITIONING

(71) Applicant: ICON Health & Fitness, Inc., Logan, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 130 days.

(21) Appl. No.: 15/712,883

(22) Filed: Sep. 22, 2017

(65) Prior Publication Data

US 2018/0099205 A1 Apr. 12, 2018

Related U.S. Application Data

(60) Provisional application No. 62/406,287, filed on Oct. 10, 2016.

(51) Int. Cl.

| | |
|---|---|
| ***A63B 71/06*** | (2006.01) |
| ***A63B 24/00*** | (2006.01) |
| ***A63B 22/00*** | (2006.01) |
| ***A63B 22/02*** | (2006.01) |

(52) U.S. Cl.

CPC ..... *A63B 71/0619* (2013.01); *A63B 22/0023* (2013.01); *A63B 22/02* (2013.01); *A63B 24/0087* (2013.01); *A63B 2071/0658* (2013.01); *A63B 2210/50* (2013.01); *A63B 2225/093* (2013.01); *A63B 2225/096* (2013.01)

(58) Field of Classification Search

CPC . A63B 22/0023; A63B 22/02; A63B 24/0087; A63B 71/0619; A63B 2071/0658; A63B 2210/50; A63B 2225/093; A63B 2225/096

See application file for complete search history.

(56) References Cited

U.S. PATENT DOCUMENTS

| | | | |
|---|---|---|---|
| 232,022 | A | 9/1880 | Gifford |
| 284,294 | A | 9/1883 | Graves |
| 321,388 | A | 6/1885 | Ruebsam |
| 339,638 | A | 4/1886 | Goldie |
| 421,779 | A | 2/1890 | Stevens |
| 447,780 | A | 3/1891 | Luge |
| 450,792 | A | 4/1891 | Dodd |
| 659,216 | A | 10/1900 | Dowling |

(Continued)

FOREIGN PATENT DOCUMENTS

| | | |
|---|---|---|
| CN | 105797307 | 7/2016 |
| CN | 105797307 A | 7/2016 |

(Continued)

OTHER PUBLICATIONS

Translation of CN 105797307 (Year: 2016).*

(Continued)

*Primary Examiner* — Megan Anderson

(74) *Attorney, Agent, or Firm* — Ray Quinney & Nebeker

(57) ABSTRACT

A method for positioning a console of an exercise device includes determining an angle formed between an exercise deck of the exercise device and a base of the exercise device and adjusting a physical height of a console of the exercise device to a correlated height based at least in part on the angle of the exercise deck when the physical height is determined to be out of alignment with the correlated height.

20 Claims, 9 Drawing Sheets

(56) References Cited

U.S. PATENT DOCUMENTS 663,486 A 12/1900 Boren
674,391 A 5/1901 Baker
683,284 A 9/1901 Honey
766,930 A 8/1904 Clemons
881,521 A 3/1908 Wilson
897,722 A 9/1908 Day
931,394 A 8/1909 Day
937,795 A 10/1909 Hackney
1,016,729 A 2/1912 Barrett
1,020,777 A 3/1912 Peterson
1,064,968 A 6/1913 Hagen
1,082,940 A 12/1913 Flora
1,211,765 A 1/1917 Schmidt
1,570,482 A 1/1926 Hale
1,580,530 A 4/1926 Rambo
1,585,748 A 5/1926 Wendelken
1,715,870 A 6/1929 Spain
1,766,089 A 6/1930 Wood
1,778,635 A 10/1930 Heisler
1,824,406 A 9/1931 Petersime
1,850,530 A 3/1932 Brown
1,893,728 A 1/1933 Bullis
1,902,694 A 3/1933 Edwards
1,919,627 A 7/1933 Fitz Gerald
1,928,089 A 9/1933 Blickman
1,973,945 A 9/1934 Chavin
1,978,579 A 10/1934 Hooks
1,982,843 A 12/1934 Traver
2,067,136 A 1/1937 Bridenbaugh
2,117,957 A 5/1938 Ritter
2,165,700 A 7/1939 Henry
2,177,957 A 10/1939 Stewart
2,219,219 A 10/1940 Boger
2,247,946 A 7/1941 Hein et al.
2,255,864 A 9/1941 Stephens
2,315,485 A 4/1943 Jones
2,399,915 A 5/1946 Drake
2,440,644 A 4/1948 Powell
2,569,007 A 9/1951 Klyce
2,607,816 A 8/1952 Ryder
2,632,645 A 3/1953 Barkschat
2,645,539 A 7/1953 Thompson
2,646,282 A 7/1953 Ringman
2,648,540 A 8/1953 Hunter
2,674,453 A 4/1954 Hummert
2,743,623 A 5/1956 Wells
2,746,822 A 5/1956 Copenhaver
2,842,365 A 7/1958 Kelley
2,855,200 A 10/1958 Blickman
2,874,971 A 2/1959 Devery
2,969,060 A 1/1961 Swanda
2,984,594 A 5/1961 Runton
3,035,671 A 5/1962 Sicherman
3,059,312 A 10/1962 Jamieson
3,068,950 A 12/1962 Davidson
3,072,426 A 1/1963 Gilbert
3,112,108 A 11/1963 Hanke
3,127,171 A 3/1964 Noland et al.
3,179,071 A 4/1965 Johnston
3,193,287 A 7/1965 Robinson
3,205,888 A 9/1965 Stroop
3,316,898 A 5/1967 Brown
3,319,273 A 5/1967 Solin
3,342,485 A 9/1967 Gaul
3,345,067 A 10/1967 Smith
3,358,813 A 12/1967 Kohlhagen
3,378,259 A 4/1968 Kupchinski
3,408,067 A 10/1968 Armstrong
3,408,069 A 10/1968 Lewis
3,411,497 A 11/1968 Rickey et al.
3,416,174 A 12/1968 Novitske
3,430,084 A 2/1969 Hall
3,430,507 A 3/1969 Hurst et al.
3,438,627 A 4/1969 La Lanne
3,444,830 A 5/1969 Doetsch
3,446,503 A 5/1969 Lawton
3,501,140 A 3/1970 Eichorn
3,511,500 A 5/1970 Dunn
3,514,110 A 5/1970 Thomander
3,518,985 A 7/1970 Quinton
3,547,435 A 12/1970 Scott
3,554,541 A 1/1971 Spoth
3,563,541 A 2/1971 Sanquist
3,566,861 A 3/1971 Weiss
3,567,219 A 3/1971 Foster
3,568,669 A 3/1971 Stites
3,572,700 A 3/1971 Mastropaolo
3,583,465 A 6/1971 Youngs et al.
3,586,322 A 6/1971 Kverneland
3,589,715 A 6/1971 Mark
3,592,466 A 7/1971 Parsons
3,598,404 A 8/1971 Bowman
3,602,502 A 8/1971 Jaegar
3,606,320 A 9/1971 Erwin, Jr.
3,608,898 A 9/1971 Berlin
3,614,097 A 10/1971 Blickman
3,628,654 A 12/1971 Haracz
3,628,791 A 12/1971 Garcia
3,634,895 A 1/1972 Childers
3,636,577 A 1/1972 Nissen
3,638,941 A 2/1972 Kulkens
3,640,528 A 2/1972 Proctor
3,641,601 A 2/1972 Sieg
3,642,279 A 2/1972 Cutter
3,643,943 A 2/1972 Erwin, Jr. et al.
3,650,529 A 3/1972 Salm
3,658,327 A 4/1972 Thiede
3,659,845 A 5/1972 Quinton
3,664,666 A 5/1972 Lloyd
3,686,776 A 8/1972 Dahl
3,689,066 A 9/1972 Hagen
3,703,284 A 11/1972 Hesen
3,708,166 A 1/1973 Annas
3,709,197 A 1/1973 Moseley
3,731,917 A 5/1973 Townsend
3,738,649 A 6/1973 Miller
3,741,538 A 6/1973 Useldinger
3,751,033 A 8/1973 Rosenthal
3,756,595 A 9/1973 Hague
3,767,195 A 10/1973 Dimick
3,788,412 A 1/1974 Vincent
3,792,860 A 2/1974 Selnes
3,809,393 A 5/1974 Jones
3,814,420 A 6/1974 Encke
3,822,488 A 7/1974 Johnson
3,826,491 A 7/1974 Elder
3,848,467 A 11/1974 Flavell
3,851,874 A 12/1974 Wilkin
3,858,938 A 1/1975 Kristensson et al.
3,861,215 A 1/1975 Bradley
3,869,121 A 3/1975 Flavell
3,870,297 A 3/1975 Elder
3,874,657 A 4/1975 Niebojewski
3,880,274 A 4/1975 Bechtloff
3,883,922 A 5/1975 Fleischhauer
3,892,404 A 7/1975 Martucci
3,901,379 A 8/1975 Bruhm
3,903,613 A 9/1975 Bisberg
3,904,196 A 9/1975 Berlin
3,909,857 A 10/1975 Herrera
3,912,263 A 10/1975 Yatso
3,918,710 A 11/1975 Niebojewski
3,926,430 A 12/1975 Good
3,929,026 A 12/1975 Hofmann
3,938,400 A 2/1976 Konyha
3,941,377 A 3/1976 Lie
3,948,513 A 4/1976 Pfotenhauer
3,963,101 A 6/1976 Stadelmann et al.
3,977,451 A 8/1976 Duba
3,981,500 A 9/1976 Ryan
4,012,015 A 3/1977 Nelson et al.
4,024,949 A 5/1977 Kleysteuber et al.
4,026,545 A 5/1977 Schonenberger
4,033,567 A 7/1977 Lipfert

(56) References Cited

U.S. PATENT DOCUMENTS

| | | | |
|---|---|---|---|
| 4,056,265 | A | 11/1977 | Ide |
| 4,063,726 | A | 12/1977 | Wilson |
| 4,063,727 | A | 12/1977 | Hall |
| 4,066,257 | A | 1/1978 | Moller |
| 4,066,259 | A | 1/1978 | Brentham |
| 4,067,372 | A | 1/1978 | Masson |
| 4,072,309 | A | 2/1978 | Wilson |
| 4,077,626 | A | 3/1978 | Newman |
| 4,082,267 | A | 4/1978 | Flavell |
| 4,093,196 | A | 6/1978 | Bauer |
| 4,094,330 | A | 6/1978 | Jong |
| 4,111,417 | A | 9/1978 | Gardner |
| 4,113,071 | A | 9/1978 | Muller et al. |
| 4,120,294 | A | 10/1978 | Wolfe |
| 4,141,158 | A | 2/1979 | Benseler et al. |
| 4,146,222 | A | 3/1979 | Hribar |
| 4,149,714 | A | 4/1979 | Lambert, Jr. |
| 4,151,988 | A | 5/1979 | Nabinger |
| 4,151,994 | A | 5/1979 | Stalberger, Jr. |
| 4,161,998 | A | 7/1979 | Trimble |
| 4,167,938 | A | 9/1979 | Remih |
| 4,168,061 | A | 9/1979 | Gordon |
| 4,171,805 | A | 10/1979 | Abbott |
| 4,179,134 | A | 12/1979 | Atkinson |
| 4,183,156 | A | 1/1980 | Rudy |
| 4,183,494 | A | 1/1980 | Cleveland |
| 4,188,030 | A | 2/1980 | Hooper |
| 4,199,139 | A | 4/1980 | Mahnke |
| 4,204,673 | A | 5/1980 | Speer, Sr. |
| 4,208,049 | A | 6/1980 | Wilson |
| 4,215,516 | A | 8/1980 | Huschle et al. |
| 4,216,856 | A | 8/1980 | Moring et al. |
| 4,227,689 | A | 10/1980 | Keiser |
| 4,235,437 | A | 11/1980 | Ruis et al. |
| 4,240,627 | A | 12/1980 | Brentham |
| 4,248,476 | A | 2/1981 | Phelps |
| 4,249,725 | A | 2/1981 | Mattox |
| 4,251,932 | A | 2/1981 | Love |
| 4,253,661 | A | 3/1981 | Russell |
| 4,258,821 | A | 3/1981 | Wendt |
| 4,258,913 | A | 3/1981 | Brentham |
| 4,274,625 | A | 6/1981 | Gaetano |
| 4,278,095 | A | 7/1981 | Lapeyre |
| 4,278,249 | A | 7/1981 | Forrest |
| 4,286,782 | A | 9/1981 | Fuhrhop |
| 4,290,601 | A | 9/1981 | Mittelstadt |
| 4,300,761 | A | 11/1981 | Howard |
| 4,313,602 | A | 2/1982 | Sullivan |
| 4,313,603 | A | 2/1982 | Simjian |
| 4,324,501 | A | 4/1982 | Herbenar |
| 4,333,978 | A | 6/1982 | Kocher |
| 4,334,676 | A | 6/1982 | Schonenberger |
| 4,334,695 | A | 6/1982 | Ashby |
| 4,337,283 | A | 6/1982 | Haas, Jr. |
| 4,342,452 | A | 8/1982 | Summa |
| 4,344,616 | A | 8/1982 | Ogden |
| 4,349,597 | A | 9/1982 | Fine et al. |
| 4,350,336 | A | 9/1982 | Hanford |
| 4,358,105 | A | 11/1982 | Sweeney, Jr. |
| 4,363,480 | A | 12/1982 | Fisher et al. |
| 4,363,486 | A | 12/1982 | Chaudhry |
| 4,367,895 | A | 1/1983 | Pacitti et al. |
| 4,369,081 | A | 1/1983 | Curry et al. |
| 4,370,766 | A | 2/1983 | Teague, Jr. |
| 4,374,587 | A | 2/1983 | Ogden |
| 4,377,045 | A | 3/1983 | Aurensan |
| 4,383,684 | A | 5/1983 | Schliep |
| 4,383,714 | A | 5/1983 | Ishida |
| 4,397,462 | A | 8/1983 | Wilmarth |
| 4,406,451 | A | 9/1983 | Gaetano |
| 4,408,613 | A | 10/1983 | Relyea |
| 4,422,635 | A | 12/1983 | Herod |
| 4,422,636 | A | 12/1983 | de Angeli |
| 4,423,864 | A | 1/1984 | Wiik |
| 4,426,077 | A | 1/1984 | Becker |
| 4,431,181 | A | 2/1984 | Baswell |
| 4,434,981 | A | 3/1984 | Norton |
| 4,441,708 | A | 4/1984 | Brentham |
| 4,445,684 | A | 5/1984 | Ruff |
| 4,452,448 | A | 6/1984 | Ausherman |
| 4,453,766 | A | 6/1984 | DiVito |
| 4,461,472 | A | 7/1984 | Martinez |
| 4,465,277 | A | 8/1984 | Dittrich |
| 4,476,582 | A | 10/1984 | Strauss et al. |
| 4,477,071 | A | 10/1984 | Brown et al. |
| 4,489,933 | A | 12/1984 | Fisher |
| 4,491,318 | A | 1/1985 | Francke |
| 4,494,662 | A | 1/1985 | Clymer |
| 4,496,147 | A | 1/1985 | DeCloux et al. |
| 4,499,784 | A | 2/1985 | Shum |
| 4,502,679 | A | 3/1985 | De Lorenzo |
| 4,505,474 | A | 3/1985 | Mattox |
| 4,505,475 | A | 3/1985 | Olschansky et al. |
| 4,509,510 | A | 4/1985 | Hook |
| 4,512,567 | A | 4/1985 | Phillips |
| 4,512,571 | A | 4/1985 | Hermelin |
| 4,522,394 | A | 6/1985 | Broussard |
| 4,529,194 | A | 7/1985 | Haaheim |
| 4,533,136 | A | 8/1985 | Smith et al. |
| 4,536,244 | A | 8/1985 | Greci et al. |
| 4,538,805 | A | 9/1985 | Parviainen |
| 4,542,899 | A | 9/1985 | Hendricks |
| 4,544,152 | A | 10/1985 | Taitel |
| 4,544,153 | A | 10/1985 | Babcock |
| 4,546,971 | A | 10/1985 | Raasoch |
| 4,548,405 | A | 10/1985 | Lee |
| 4,549,733 | A | 10/1985 | Salyer |
| 4,556,216 | A | 12/1985 | Pitkanen |
| 4,563,001 | A | 1/1986 | Terauds |
| 4,563,003 | A | 1/1986 | Bugallo et al. |
| 4,564,193 | A | 1/1986 | Stewart |
| 4,566,689 | A | 1/1986 | Ogden |
| 4,566,732 | A | 1/1986 | Ostergaard, Sr. |
| 4,569,518 | A | 2/1986 | Fulks |
| 4,571,682 | A | 2/1986 | Silverman et al. |
| 4,572,500 | A | 2/1986 | Weiss |
| 4,572,504 | A | 2/1986 | DiBartolo |
| 4,576,352 | A | 3/1986 | Ogden |
| 4,576,376 | A | 3/1986 | Miller |
| 4,577,860 | A | 3/1986 | Matias et al. |
| 4,580,983 | A | 4/1986 | Cassini et al. |
| 4,581,269 | A | 4/1986 | Tilman |
| 4,582,320 | A | 4/1986 | Shaw |
| 4,589,656 | A | 5/1986 | Baldwin |
| 4,591,147 | A | 5/1986 | Smith et al. |
| 4,592,544 | A | 6/1986 | Smith et al. |
| 4,600,196 | A | 7/1986 | Jones |
| 4,601,142 | A | 7/1986 | Frommelt |
| 4,602,779 | A | 7/1986 | Ogden |
| 4,610,449 | A | 9/1986 | Diercks, Jr. |
| 4,614,337 | A | 9/1986 | Schonenberger |
| 4,616,822 | A | 10/1986 | Trulaske |
| 4,618,139 | A | 10/1986 | Haaheim |
| 4,618,140 | A | 10/1986 | Brown |
| 4,619,454 | A | 10/1986 | Walton |
| 4,621,623 | A | 11/1986 | Wang |
| 4,624,457 | A | 11/1986 | Silberman et al. |
| 4,625,962 | A | 12/1986 | Street |
| 4,627,614 | A | 12/1986 | De Angeli |
| 4,627,615 | A | 12/1986 | Nurkowski |
| 4,627,616 | A | 12/1986 | Kauffman |
| 4,630,817 | A | 12/1986 | Buckley |
| 4,632,385 | A | 12/1986 | Geraci |
| 4,632,386 | A | 12/1986 | Beech |
| 4,632,390 | A | 12/1986 | Richey |
| 4,634,127 | A | 1/1987 | Rockwell |
| 4,635,927 | A | 1/1987 | Shu |
| 4,635,928 | A | 1/1987 | Ogden et al. |
| 4,637,605 | A | 1/1987 | Ritchie |
| 4,638,523 | A | 1/1987 | Todd |
| 4,638,969 | A | 1/1987 | Brown |
| 4,641,833 | A | 2/1987 | Trethewey |
| 4,642,080 | A | 2/1987 | Takano et al. |
| 4,643,418 | A | 2/1987 | Bart |

(56) References Cited

U.S. PATENT DOCUMENTS 4,645,197 A 2/1987 Mcfee
4,645,200 A 2/1987 Hix
4,645,201 A 2/1987 Evans
4,645,917 A 2/1987 Penney et al.
4,647,041 A 3/1987 Whiteley
4,650,067 A 3/1987 Brule
4,650,184 A 3/1987 Brebner
4,650,185 A 3/1987 Cartwright
4,651,581 A 3/1987 Svensson
4,659,074 A 4/1987 Taitel et al.
4,659,077 A 4/1987 Stropkay
4,659,078 A 4/1987 Blome
4,662,630 A 5/1987 Dignard et al.
4,664,371 A 5/1987 Viander
4,664,373 A 5/1987 Hait
4,664,646 A 5/1987 Rorabaugh
4,673,177 A 6/1987 Szymski
4,674,740 A 6/1987 Iams et al.
4,674,743 A 6/1987 Hirano
4,678,185 A 7/1987 Mahnke
4,679,787 A 7/1987 Guilbault
4,684,121 A 8/1987 Nestegard
4,685,670 A 8/1987 Zinkin
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,708,337 A 11/1987 Shyu
4,709,917 A 12/1987 Yang
4,709,918 A 12/1987 Grinblat
4,709,920 A 12/1987 Schnell
4,711,447 A 12/1987 Mansfield
4,714,248 A 12/1987 Koss
4,718,207 A 1/1988 Frommelt
4,720,093 A 1/1988 Del Mar
4,720,099 A 1/1988 Carlson
4,720,789 A 1/1988 Hector et al.
4,721,303 A 1/1988 Fitzpatrick
4,725,057 A 2/1988 Shifferaw
4,726,581 A 2/1988 Chang
4,729,558 A 3/1988 Kuo
4,729,562 A 3/1988 Pipasik
4,733,858 A 3/1988 Lan
4,743,009 A 5/1988 Beale
4,743,015 A 5/1988 Marshall
4,744,559 A 5/1988 Mahnke et al.
4,746,115 A 5/1988 Lahman
4,749,184 A 6/1988 Tobin
4,750,736 A 6/1988 Watterson
4,751,755 A 6/1988 Carey, Jr. et al.
4,756,098 A 7/1988 Boggia
4,757,987 A 7/1988 Allemand
4,759,540 A 7/1988 Yu et al.
4,771,148 A 9/1988 Bersonnet
4,772,015 A 9/1988 Carlson et al.
4,773,170 A 9/1988 Moore et al.
4,776,582 A 10/1988 Ramhorst
4,779,884 A 10/1988 Minati
4,786,049 A 11/1988 Lautenschlager
4,786,050 A 11/1988 Geschwender
4,790,528 A 12/1988 Nakao et al.
4,792,134 A 12/1988 Chen
4,797,968 A 1/1989 Wenzlick
4,798,760 A 1/1989 Diaz-Kotti
4,799,475 A 1/1989 Iams et al.
4,799,671 A 1/1989 Hoggan et al.
4,801,079 A 1/1989 Gonella
4,804,178 A 2/1989 Friedebach
4,805,901 A 2/1989 Kulick
4,807,874 A 2/1989 Little
4,809,804 A 3/1989 Houston et al.
4,809,972 A 3/1989 Rasmussen et al.
4,813,667 A 3/1989 Watterson
4,813,668 A 3/1989 Solloway
4,813,743 A 3/1989 Mizelle
4,817,939 A 4/1989 Augspurger et al.
4,818,175 A 4/1989 Kimura
4,819,583 A 4/1989 Guerra
4,822,029 A 4/1989 Sarno
4,822,034 A 4/1989 Shields
4,824,104 A 4/1989 Bloch
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,830,362 A 5/1989 Bull
4,832,332 A 5/1989 Dumbser
4,836,530 A 6/1989 Stanley, Jr.
4,838,543 A 6/1989 Armstrong et al.
4,838,544 A 6/1989 Sasakawa et al.
4,842,266 A 6/1989 Sweeney, Sr.
4,842,274 A 6/1989 Oosthuizen
4,844,449 A 7/1989 Truslaske
4,844,450 A 7/1989 Rodgers, Jr.
4,848,737 A 7/1989 Ehrenfield
4,850,585 A 7/1989 Dalebout
4,861,023 A 8/1989 Wedman
4,861,025 A 8/1989 Rockwell
4,863,161 A 9/1989 Telle
4,865,344 A 9/1989 Romero, Sr. et al.
4,867,443 A 9/1989 Jensen
4,869,493 A 9/1989 Johnston
4,869,494 A 9/1989 Lambert, Sr.
4,869,497 A 9/1989 Stewart et al.
4,875,676 A 10/1989 Zimmer
4,877,239 A 10/1989 Dela Rosa
4,878,662 A 11/1989 Chern
4,878,663 A 11/1989 Luquette
4,880,227 A 11/1989 Sowell
4,883,272 A 11/1989 Lay
4,886,266 A 12/1989 Trulaske
4,891,764 A 1/1990 McIntosh
4,894,933 A 1/1990 Tonkel et al.
4,898,379 A 2/1990 Shiba
4,898,381 A 2/1990 Gordon
4,900,012 A 2/1990 Fu
4,900,017 A 2/1990 Bold, Jr.
4,900,018 A 2/1990 Ish, III
4,902,006 A 2/1990 Stallings, Jr.
4,904,829 A 2/1990 Berthaud et al.
4,905,330 A 3/1990 Jacobs
4,907,795 A 3/1990 Shaw et al.
4,907,797 A 3/1990 Gezari et al.
4,907,798 A 3/1990 Burchatz
4,909,504 A 3/1990 Yang
4,911,438 A 3/1990 Van Straaten
4,913,396 A 4/1990 Dalebout et al.
4,913,423 A 4/1990 Farran
4,915,377 A 4/1990 Malnke et al.
4,915,379 A 4/1990 Sapp
4,917,376 A 4/1990 Lo
4,919,418 A 4/1990 Miller
4,919,419 A 4/1990 Houston
4,921,242 A 5/1990 Watterson
4,921,247 A 5/1990 Sterling
4,923,193 A 5/1990 Pitzen et al.
4,925,183 A 5/1990 Kim
4,925,724 A 5/1990 Ogden
4,927,136 A 5/1990 Leask
4,928,546 A 5/1990 Walters
4,928,957 A 5/1990 Lanier et al.
4,930,768 A 6/1990 Lapcevic
4,930,769 A 6/1990 Nenoff
4,934,690 A 6/1990 Bull
4,934,692 A 6/1990 Owens
4,938,473 A 7/1990 Lee
4,940,233 A 7/1990 Bull
4,941,652 A 7/1990 Nagano et al.
4,941,673 A 7/1990 Bennett
4,948,121 A 8/1990 Haaheim et al.
4,949,954 A 8/1990 Hix

(56) References Cited

U.S. PATENT DOCUMENTS

| | | | |
|---|---|---|---|
| 4,949,958 | A | 8/1990 | Richey |
| 4,949,959 | A | 8/1990 | Stevens |
| 4,952,265 | A | 8/1990 | Yamanaka et al. |
| 4,953,415 | A | 9/1990 | Lehtonen |
| 4,953,858 | A | 9/1990 | Zelli |
| 4,955,466 | A | 9/1990 | Almes et al. |
| 4,958,832 | A | 9/1990 | Kim |
| 4,960,276 | A | 10/1990 | Feuer et al. |
| 4,964,632 | A | 10/1990 | Rockwell |
| 4,968,028 | A | 11/1990 | Wehrell |
| 4,971,316 | A | 11/1990 | Dalebout et al. |
| 4,974,831 | A | 12/1990 | Dunham |
| 4,974,832 | A | 12/1990 | Dalebout |
| 4,976,424 | A | 12/1990 | Sargeant et al. |
| 4,976,428 | A | 12/1990 | Ghazi |
| 4,976,435 | A | 12/1990 | Shatford |
| 4,984,810 | A | 1/1991 | Stearns et al. |
| 4,986,261 | A | 1/1991 | Iams et al. |
| 4,989,860 | A | 2/1991 | Iams et al. |
| 4,998,725 | A | 3/1991 | Watterson et al. |
| 5,000,440 | A | 3/1991 | Lynch |
| 5,000,442 | A | 3/1991 | Dalebout et al. |
| 5,001,632 | A | 3/1991 | Hall Tipping |
| 5,002,271 | A | 3/1991 | Gonzales |
| 5,004,224 | A | 4/1991 | Wang |
| 5,007,630 | A | 4/1991 | Real et al. |
| 5,007,631 | A | 4/1991 | Wang |
| 5,013,031 | A | 5/1991 | Bull |
| 5,016,870 | A | 5/1991 | Bulloch et al. |
| 5,020,793 | A | 6/1991 | Loane |
| 5,024,441 | A | 6/1991 | Rousseau |
| 5,026,049 | A | 6/1991 | Goodman |
| 5,027,303 | A | 6/1991 | Witte |
| 5,029,801 | A | 7/1991 | Dalebout et al. |
| 5,031,455 | A | 7/1991 | Cline |
| 5,031,901 | A | 7/1991 | Saarinen |
| 5,034,576 | A | 7/1991 | Dalebout et al. |
| 5,037,084 | A | 8/1991 | Flor |
| 5,037,089 | A | 8/1991 | Spagnuolo |
| 5,039,089 | A | 8/1991 | Lapcevic |
| 5,039,091 | A | 8/1991 | Johnson |
| 5,042,799 | A | 8/1991 | Stanley |
| 5,046,382 | A | 9/1991 | Steinberg |
| 5,046,722 | A | 9/1991 | Antoon |
| 5,048,823 | A | 9/1991 | Bean |
| 5,051,638 | A | 9/1991 | Pyles |
| 5,054,770 | A | 10/1991 | Bull |
| 5,058,881 | A | 10/1991 | Measom |
| 5,058,882 | A | 10/1991 | Dalebout et al. |
| 5,058,888 | A | 10/1991 | Walker et al. |
| 5,062,626 | A | 11/1991 | Dalebout et al. |
| 5,062,629 | A | 11/1991 | Vaughan |
| 5,062,632 | A | 11/1991 | Dalebout et al. |
| 5,066,000 | A | 11/1991 | Dolan |
| 5,067,710 | A | 11/1991 | Watterson et al. |
| 5,071,115 | A | 12/1991 | Welch |
| 5,072,928 | A | 12/1991 | Stearns et al. |
| 5,072,929 | A | 12/1991 | Peterson et al. |
| 5,074,550 | A | 12/1991 | Sloan |
| 5,077,916 | A | 1/1992 | Beneteau |
| 5,080,353 | A | 1/1992 | Tench |
| 5,081,991 | A | 1/1992 | Chance |
| 5,085,426 | A | 2/1992 | Wanzer et al. |
| 5,085,427 | A | 2/1992 | Finn |
| 5,087,047 | A | 2/1992 | McConnell |
| 5,088,729 | A | 2/1992 | Dalebout |
| 5,094,249 | A | 3/1992 | Marras et al. |
| 5,094,447 | A | 3/1992 | Wang |
| 5,096,225 | A | 3/1992 | Osawa |
| 5,102,122 | A | 4/1992 | Piane, Jr. |
| 5,102,380 | A | 4/1992 | Jacobson et al. |
| 5,104,119 | A | 4/1992 | Lynch |
| 5,104,120 | A | 4/1992 | Watterson et al. |
| 5,108,093 | A | 4/1992 | Watterson |
| 5,109,778 | A | 5/1992 | Berkowitz et al. |
| 5,110,117 | A | 5/1992 | Fisher et al. |
| 5,112,045 | A | 5/1992 | Mason et al. |
| 5,114,388 | A | 5/1992 | Trulaske |
| 5,114,391 | A | 5/1992 | Pitzen et al. |
| 5,123,629 | A | 6/1992 | Takeuchi |
| 5,123,885 | A | 6/1992 | Shields |
| 5,123,886 | A | 6/1992 | Cook |
| 5,129,872 | A | 7/1992 | Dalton et al. |
| 5,131,895 | A | 7/1992 | Rogers, Jr. |
| 5,135,458 | A | 8/1992 | Huang |
| 5,137,501 | A | 8/1992 | Mertesdorf |
| 5,138,730 | A | 8/1992 | Masuda |
| 5,141,480 | A | 8/1992 | Lennox et al. |
| 5,142,358 | A | 8/1992 | Jason |
| 5,145,475 | A | 9/1992 | Cares |
| 5,145,481 | A | 9/1992 | Friedebach |
| 5,147,266 | A | 9/1992 | Ricard |
| 5,149,084 | A | 9/1992 | Dalebout et al. |
| 5,149,312 | A | 9/1992 | Croft et al. |
| 5,154,684 | A | 10/1992 | Delf |
| 5,158,520 | A | 10/1992 | Lemke et al. |
| 5,162,029 | A | 11/1992 | Schine |
| 5,163,885 | A | 11/1992 | Wanzer et al. |
| 5,167,159 | A | 12/1992 | Lucking |
| 5,167,597 | A | 12/1992 | David |
| 5,171,196 | A | 12/1992 | Lynch |
| 5,178,593 | A | 1/1993 | Roberts |
| 5,178,599 | A | 1/1993 | Scott |
| 5,181,894 | A | 1/1993 | Shieng |
| 5,184,295 | A | 2/1993 | Mann |
| 5,184,988 | A | 2/1993 | Dunham |
| 5,186,697 | A | 2/1993 | Rennex |
| 5,192,255 | A | 3/1993 | Dalebout et al. |
| 5,192,257 | A | 3/1993 | Panasewicz |
| 5,192,258 | A | 3/1993 | Keller |
| 5,195,781 | A | 3/1993 | Osawa |
| 5,195,935 | A | 3/1993 | Fencel |
| 5,195,937 | A | 3/1993 | Engel et al. |
| 5,199,931 | A | 4/1993 | Easley et al. |
| 5,201,694 | A | 4/1993 | Zappel |
| 5,203,229 | A | 4/1993 | Chen |
| 5,203,800 | A | 4/1993 | Meredith |
| 5,203,826 | A | 4/1993 | Dalebout |
| 5,205,798 | A | 4/1993 | Lekhtman |
| 5,205,800 | A | 4/1993 | Grant |
| 5,207,489 | A | 5/1993 | Miller |
| 5,207,622 | A | 5/1993 | Wilkinson et al. |
| 5,207,625 | A | 5/1993 | White |
| 5,207,628 | A | 5/1993 | Graham |
| 5,211,617 | A | 5/1993 | Millen |
| 5,215,510 | A | 6/1993 | Baran |
| 5,217,422 | A | 6/1993 | Domzalski |
| 5,226,866 | A | 7/1993 | Engel et al. |
| 5,232,422 | A | 8/1993 | Bishop, Jr. |
| 5,234,392 | A | 8/1993 | Clark |
| 5,240,417 | A | 8/1993 | Smithson et al. |
| 5,242,339 | A | 9/1993 | Thornton |
| 5,242,340 | A | 9/1993 | Jerome |
| 5,242,343 | A | 9/1993 | Miller |
| 5,242,347 | A | 9/1993 | Keeton |
| 5,247,853 | A | 9/1993 | Dalebout |
| 5,250,012 | A | 10/1993 | Whitcomb, Jr. |
| 5,250,013 | A | 10/1993 | Brangi |
| 5,254,067 | A | 10/1993 | Habing et al. |
| 5,256,117 | A | 10/1993 | Potts et al. |
| 5,256,118 | A | 10/1993 | Chen |
| 5,256,126 | A | 10/1993 | Grotstein |
| 5,257,701 | A | 11/1993 | Edelson |
| 5,257,964 | A | 11/1993 | Petters |
| 5,261,864 | A | 11/1993 | Fitzpatrick |
| 5,269,736 | A | 12/1993 | Roberts |
| 5,271,416 | A | 12/1993 | Lepley |
| 5,273,285 | A | 12/1993 | Long |
| 5,277,678 | A | 1/1994 | Friedebach et al. |
| 5,279,528 | A | 1/1994 | Dalebout et al. |
| 5,279,529 | A | 1/1994 | Eschenbach |
| 5,279,531 | A | 1/1994 | Jen Huey |
| 5,282,776 | A | 2/1994 | Dalebout |
| 5,284,461 | A | 2/1994 | Wilkinson et al. |

(56) References Cited

U.S. PATENT DOCUMENTS

| | | | |
|---|---|---|---|
| 5,290,205 | A | 3/1994 | Densmore et al. |
| 5,290,211 | A | 3/1994 | Stearns |
| 5,292,293 | A | 3/1994 | Schumacher |
| 5,295,927 | A | 3/1994 | Easley |
| 5,295,928 | A | 3/1994 | Rennex |
| 5,295,935 | A | 3/1994 | Wang |
| 5,299,992 | A | 4/1994 | Wilkinson |
| 5,299,993 | A | 4/1994 | Habing |
| 5,302,162 | A | 4/1994 | Pasero |
| 5,306,221 | A | 4/1994 | Itaru |
| 5,308,075 | A | 5/1994 | Theriault |
| 5,308,304 | A | 5/1994 | Habing |
| 5,310,392 | A | 5/1994 | Lo |
| 5,313,852 | A | 5/1994 | Arena |
| 5,314,390 | A | 5/1994 | Westing et al. |
| 5,314,391 | A | 5/1994 | Potash et al. |
| 5,314,392 | A | 5/1994 | Hawkins et al. |
| 5,314,394 | A | 5/1994 | Ronan |
| 5,318,487 | A | 6/1994 | Golen et al. |
| 5,320,343 | A | 6/1994 | McKinney |
| 5,320,588 | A | 6/1994 | Wanzer et al. |
| 5,320,591 | A | 6/1994 | Harmon et al. |
| 5,324,242 | A | 6/1994 | Lo |
| 5,328,420 | A | 7/1994 | Allen |
| 5,328,422 | A | 7/1994 | Nichols |
| 5,328,429 | A | 7/1994 | Potash et al. |
| 5,330,401 | A | 7/1994 | Walstead |
| 5,330,402 | A | 7/1994 | Johnson |
| 5,334,120 | A | 8/1994 | Rasmussen |
| 5,336,144 | A | 8/1994 | Rodden |
| 5,336,145 | A | 8/1994 | Keiser |
| 5,336,146 | A | 8/1994 | Piaget et al. |
| 5,342,264 | A | 8/1994 | Gordon |
| 5,342,271 | A | 8/1994 | Long |
| 5,344,372 | A | 9/1994 | Hung |
| 5,348,524 | A | 9/1994 | Grant |
| 5,350,344 | A | 9/1994 | Kissel |
| 5,352,166 | A | 10/1994 | Chang |
| 5,352,167 | A | 10/1994 | Ulicny |
| 5,352,169 | A | 10/1994 | Eschenbach |
| 5,353,452 | A | 10/1994 | Rulis |
| 5,354,248 | A | 10/1994 | Rawls et al. |
| 5,354,251 | A | 10/1994 | Sleamaker |
| 5,356,356 | A | 10/1994 | Hildebrandt et al. |
| 5,358,461 | A | 10/1994 | Bailey, Jr. |
| 5,362,069 | A | 11/1994 | Hall-Tipping |
| 5,362,295 | A | 11/1994 | Nurge |
| 5,364,327 | A | 11/1994 | Graham |
| 5,368,532 | A | 11/1994 | Farnet |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,227 | A | 12/1994 | Webb |
| 5,378,212 | A | 1/1995 | Pin-Kuo |
| 5,380,258 | A | 1/1995 | Hawley, Jr. |
| 5,382,207 | A | 1/1995 | Skowronski et al. |
| 5,382,208 | A | 1/1995 | Hu |
| 5,382,209 | A | 1/1995 | Pasier |
| 5,383,827 | A | 1/1995 | Stern |
| 5,383,828 | A | 1/1995 | Sands et al. |
| 5,385,346 | A | 1/1995 | Carroll et al. |
| 5,385,519 | A | 1/1995 | Hsu |
| 5,387,169 | A | 2/1995 | Wang |
| 5,387,170 | A | 2/1995 | Rawls et al. |
| 5,387,171 | A | 2/1995 | Casey et al. |
| 5,394,922 | A | 3/1995 | Colson et al. |
| 5,396,876 | A | 3/1995 | Liscio et al. |
| 5,398,948 | A | 3/1995 | Mathis |
| 5,401,226 | A | 3/1995 | Stearns |
| 5,403,251 | A | 4/1995 | Belsito et al. |
| 5,403,252 | A | 4/1995 | Leon et al. |
| 5,403,253 | A | 4/1995 | Gaylord |
| 5,403,254 | A | 4/1995 | Lundin et al. |
| 5,403,255 | A | 4/1995 | Johnston |
| 5,406,661 | A | 4/1995 | Pekar |
| 5,407,403 | A | 4/1995 | Coleman |
| 5,407,408 | A | 4/1995 | Wilkinson |
| 5,409,435 | A | 4/1995 | Daniels |
| RE34,959 | E | 5/1995 | Potts |
| 5,410,971 | A | 5/1995 | Golden et al. |
| 5,417,643 | A | 5/1995 | Taylor |
| 5,419,570 | A | 5/1995 | Bollotte |
| 5,419,571 | A | 5/1995 | Vaughan |
| 5,419,751 | A | 5/1995 | Byrd et al. |
| 5,423,729 | A | 6/1995 | Eschenbach |
| 5,423,730 | A | 6/1995 | Hirsch |
| 5,429,563 | A | 7/1995 | Engel et al. |
| 5,429,569 | A | 7/1995 | Gunnari |
| 5,431,612 | A | 7/1995 | Holden |
| 5,433,679 | A | 7/1995 | Szymczak et al. |
| 5,435,315 | A | 7/1995 | McPhee et al. |
| 5,435,798 | A | 7/1995 | Habing et al. |
| 5,441,467 | A | 8/1995 | Stevens |
| 5,441,468 | A | 8/1995 | Deckers et al. |
| 5,449,334 | A | 9/1995 | Kingsbury |
| 5,454,772 | A | 10/1995 | Rodden |
| 5,454,773 | A | 10/1995 | Blanchard et al. |
| 5,456,648 | A | 10/1995 | Edinburg |
| 5,460,586 | A | 10/1995 | Wilkinson |
| 5,462,503 | A | 10/1995 | Benjamin et al. |
| 5,462,504 | A | 10/1995 | Trulaske et al. |
| 5,466,200 | A | 11/1995 | Ulrich et al. |
| 5,466,203 | A | 11/1995 | Chen |
| 5,470,298 | A | 11/1995 | Curtis |
| 5,471,405 | A | 11/1995 | Marsh |
| 5,474,087 | A | 12/1995 | Nashner |
| 5,474,510 | A | 12/1995 | Chen |
| 5,476,430 | A | 12/1995 | Lee et al. |
| 5,484,358 | A | 1/1996 | Wang et al. |
| 5,484,362 | A | 1/1996 | Skowronski et al. |
| 5,487,707 | A | 1/1996 | Sharf et al. |
| 5,489,249 | A | 2/1996 | Brewer et al. |
| 5,489,250 | A | 2/1996 | Densmore et al. |
| 5,490,818 | A | 2/1996 | Haber et al. |
| 5,492,514 | A | 2/1996 | Daum |
| 5,492,520 | A | 2/1996 | Brown |
| 5,496,235 | A | 3/1996 | Stevens |
| 5,496,236 | A | 3/1996 | Buonauito |
| 5,496,238 | A | 3/1996 | Taylor |
| 5,496,239 | A | 3/1996 | Kallman |
| 5,499,956 | A | 3/1996 | Habing et al. |
| 5,505,011 | A | 4/1996 | Bleimhofer |
| 5,507,271 | A | 4/1996 | Actor |
| 5,509,870 | A | 4/1996 | Lloyd |
| 5,512,025 | A | 4/1996 | Dalebout et al. |
| 5,512,029 | A | 4/1996 | Barnard |
| 5,514,053 | A | 5/1996 | Hawkins et al. |
| 5,518,471 | A | 5/1996 | Hettinger et al. |
| 5,518,473 | A | 5/1996 | Miller |
| 5,520,599 | A | 5/1996 | Chen |
| 5,522,783 | A | 6/1996 | Gordon |
| 5,527,245 | A | 6/1996 | Dalebout et al. |
| 5,529,554 | A | 6/1996 | Eschenbach |
| 5,531,658 | A | 7/1996 | Liao |
| 5,533,899 | A | 7/1996 | Young |
| 5,533,948 | A | 7/1996 | Wilkinson |
| 5,533,951 | A | 7/1996 | Chang |
| 5,538,489 | A | 7/1996 | Magid |
| 5,542,892 | A | 8/1996 | Buhler |
| 5,545,112 | A | 8/1996 | Densmore et al. |
| 5,549,052 | A | 8/1996 | Hoffman |
| 5,549,536 | A | 8/1996 | Clark |
| 5,551,934 | A | 9/1996 | Binette |
| 5,551,937 | A | 9/1996 | Kwo |
| 5,554,033 | A | 9/1996 | Bizzi et al. |
| 5,554,083 | A | 9/1996 | Chen |
| 5,556,362 | A | 9/1996 | Whipps |
| 5,562,572 | A | 10/1996 | Carmein |
| 5,562,574 | A | 10/1996 | Miller |
| 5,563,487 | A | 10/1996 | Davis |
| 5,568,993 | A | 10/1996 | Potzick |
| 5,569,128 | A | 10/1996 | Dalebout |
| 5,569,138 | A | 10/1996 | Wang et al. |

(56) References Cited

U.S. PATENT DOCUMENTS 5,573,485 A 11/1996 Geschwender
5,575,740 A 11/1996 Piaget
5,577,985 A 11/1996 Miller
5,577,987 A 11/1996 Brown
5,580,249 A 12/1996 Jacobsen et al.
5,582,563 A 12/1996 Fan
5,584,700 A 12/1996 Feldman et al.
5,584,779 A 12/1996 Knecht
5,586,736 A 12/1996 Mollet
5,588,938 A 12/1996 Schneider et al.
5,590,893 A 1/1997 Robinson et al.
5,591,104 A 1/1997 Andrus et al.
5,591,106 A 1/1997 Dalebout et al.
5,591,107 A 1/1997 Rodgers, Jr.
5,591,908 A 1/1997 Reid
5,593,372 A 1/1997 Rodgers, Jr.
5,593,380 A 1/1997 Bittikofer
5,595,556 A 1/1997 Dalebout et al.
5,599,261 A 2/1997 Easley et al.
5,600,310 A 2/1997 Whipple, III et al.
5,603,675 A 2/1997 Wu
5,603,678 A 2/1997 Wilson
5,607,375 A 3/1997 Dalebout
5,613,216 A 3/1997 Galler
5,613,856 A 3/1997 Hoover
5,616,103 A 4/1997 Lee
5,622,527 A 4/1997 Watterson et al.
5,625,577 A 4/1997 Kunii et al.
5,626,539 A 5/1997 Piaget
5,630,566 A 5/1997 Case
5,632,209 A 5/1997 Sakakibara
5,634,870 A 6/1997 Wilkinson
5,643,142 A 7/1997 Salerno et al.
5,643,144 A 7/1997 Trulaske
5,643,147 A 7/1997 Huang
5,643,152 A 7/1997 Simonson
5,643,153 A 7/1997 Nylen et al.
5,643,157 A 7/1997 Seliber
5,645,509 A 7/1997 Brewer et al.
5,645,914 A 7/1997 Horowitz
5,649,882 A 7/1997 Parikh et al.
5,650,709 A 7/1997 Rotunda et al.
5,653,662 A 8/1997 Rodgers, Jr.
5,655,997 A 8/1997 Greenberg et al.
5,656,003 A 8/1997 Robinson et al.
5,658,227 A 8/1997 Stearns
5,662,557 A 9/1997 Watterson et al.
5,665,031 A 9/1997 Hsieh
5,665,033 A 9/1997 Palmer
5,667,459 A 9/1997 Su
5,669,833 A 9/1997 Stone
5,669,857 A 9/1997 Watterson et al.
5,669,865 A 9/1997 Gordon
5,672,140 A 9/1997 Watterson et al.
5,674,156 A 10/1997 Watterson et al.
5,674,453 A 10/1997 Watterson et al.
5,676,624 A 10/1997 Watterson et al.
5,679,047 A 10/1997 Engel
5,679,101 A 10/1997 Magid
5,683,332 A 11/1997 Watterson et al.
5,685,804 A 11/1997 Whan-Tong et al.
5,688,209 A 11/1997 Trulaske et al.
5,688,216 A 11/1997 Mauriello
5,690,582 A 11/1997 Ulrich et al.
5,690,587 A 11/1997 Gruenangerl
5,690,589 A 11/1997 Rodgers, Jr.
5,692,994 A 12/1997 Eschenbach
5,695,436 A 12/1997 Huang
5,702,325 A 12/1997 Watterson et al.
5,704,879 A 1/1998 Watterson et al.
5,707,319 A 1/1998 Riley
5,708,355 A 1/1998 Schrey
5,709,632 A 1/1998 Socwell
5,709,633 A 1/1998 Sokol
5,711,745 A 1/1998 Yang
5,711,749 A 1/1998 Miller
5,713,549 A 2/1998 Shieh
5,713,821 A 2/1998 Nissen
5,716,308 A 2/1998 Lee
5,718,657 A 2/1998 Dalebout et al.
5,718,660 A 2/1998 Chen
5,720,200 A 2/1998 Anderson et al.
5,720,474 A 2/1998 Sugiyama
5,722,917 A 3/1998 Olschansky et al.
5,722,920 A 3/1998 Bauer
5,722,922 A 3/1998 Watterson et al.
5,725,459 A 3/1998 Rexach
5,730,236 A 3/1998 Miller et al.
5,733,228 A 3/1998 Stevens
5,733,229 A 3/1998 Dalebout et al.
5,735,586 A 4/1998 Cheng
5,735,773 A 4/1998 Vittone
5,735,776 A 4/1998 Swezey
5,738,612 A 4/1998 Tsuda
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,749,372 A 5/1998 Allen
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,897 A 5/1998 Skowronski et al.
5,755,642 A 5/1998 Miller
5,755,645 A 5/1998 Miller et al.
5,755,651 A 5/1998 Homyonfer
5,759,136 A 6/1998 Chen
5,760,353 A 6/1998 Rapp
5,761,831 A 6/1998 Cho
5,762,587 A 6/1998 Dalebout et al.
5,762,588 A 6/1998 Chen
5,769,759 A 6/1998 Alter
5,771,152 A 6/1998 Crompton et al.
5,772,522 A 6/1998 Nesbit
5,772,558 A 6/1998 Rodgers, Jr.
5,772,560 A 6/1998 Watterson et al.
5,776,582 A 7/1998 Needham
5,779,599 A 7/1998 Chen
5,779,607 A 7/1998 Harris
5,782,639 A 7/1998 Beal
5,782,723 A 7/1998 Kuo
5,785,630 A 7/1998 Bobick et al.
5,788,609 A 8/1998 Miller
5,788,610 A 8/1998 Eschenbach
5,788,611 A 8/1998 Kuo
5,792,027 A 8/1998 Gvoich
5,792,031 A 8/1998 Alton
5,795,270 A 8/1998 Woods et al.
5,797,578 A 8/1998 Graffeo
5,803,874 A 9/1998 Wilkinson
5,803,882 A 9/1998 Habing et al.
5,807,210 A 9/1998 Devlin
5,810,696 A 9/1998 Webb
5,810,697 A 9/1998 Joiner
5,810,698 A 9/1998 Hullett et al.
5,813,142 A 9/1998 Demon
5,813,947 A 9/1998 Densmore
5,813,953 A 9/1998 Whipple
5,816,981 A 10/1998 Hung
5,820,478 A 10/1998 Wood et al.
5,823,618 A 10/1998 Fox et al.
5,827,155 A 10/1998 Jensen et al.
5,827,158 A 10/1998 Drecksel
5,830,107 A 11/1998 Brigliadoro
5,830,113 A 11/1998 Coody et al.
5,830,114 A 11/1998 Halfen et al.
5,833,577 A 11/1998 Hurt
5,833,583 A 11/1998 Chuang
5,833,584 A 11/1998 Piaget et al.
5,833,587 A 11/1998 Strong et al.

(56) References Cited

U.S. PATENT DOCUMENTS

| | | | |
|---|---|---|---|
| 5,836,770 | A | 11/1998 | Powers |
| 5,839,990 | A | 11/1998 | Virkkala |
| 5,839,993 | A | 11/1998 | Fox |
| 5,842,961 | A | 12/1998 | Davis |
| 5,846,166 | A | 12/1998 | Kuo |
| 5,848,954 | A | 12/1998 | Stearns et al. |
| 5,852,264 | A | 12/1998 | Muller |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,943 | A | 1/1999 | Murray |
| 5,860,893 | A | 1/1999 | Watterson et al. |
| 5,860,894 | A | 1/1999 | Dalebout et al. |
| 5,860,899 | A | 1/1999 | Rassman |
| 5,865,710 | A | 2/1999 | Wilson-Hyde |
| 5,868,108 | A | 2/1999 | Schmitz et al. |
| 5,868,648 | A | 2/1999 | Coody et al. |
| 5,871,421 | A | 2/1999 | Trulaske et al. |
| 5,876,095 | A | 3/1999 | Johnston |
| 5,879,271 | A | 3/1999 | Stearns et al. |
| 5,879,273 | A | 3/1999 | Wei |
| 5,879,276 | A | 3/1999 | Miller |
| 5,882,281 | A | 3/1999 | Stearns et al. |
| 5,885,197 | A | 3/1999 | Barton |
| 5,888,172 | A | 3/1999 | Andrus et al. |
| 5,890,562 | A | 4/1999 | Bartels et al. |
| 5,890,995 | A | 4/1999 | Bobick et al. |
| 5,891,001 | A | 4/1999 | Carnes et al. |
| 5,891,003 | A | 4/1999 | Deac et al. |
| 5,895,339 | A | 4/1999 | Maresh |
| 5,895,340 | A | 4/1999 | Keller |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,899,833 | A | 5/1999 | Ryan et al. |
| 5,899,834 | A | 5/1999 | Dalebout et al. |
| 5,902,214 | A | 5/1999 | Makikawa et al. |
| 5,904,398 | A | 5/1999 | Farricielli |
| 5,904,636 | A | 5/1999 | Chen |
| 5,906,269 | A | 5/1999 | Zabron et al. |
| 5,906,564 | A | 5/1999 | Jacobsen |
| 5,910,070 | A | 6/1999 | Henry et al. |
| 5,910,072 | A | 6/1999 | Rawls et al. |
| 5,911,132 | A | 6/1999 | Sloane |
| 5,913,751 | A | 6/1999 | Eschenbach |
| 5,916,064 | A | 6/1999 | Eschenbach |
| 5,916,069 | A | 6/1999 | Wang |
| 5,917,692 | A | 6/1999 | Schmitz et al. |
| 5,919,118 | A | 7/1999 | Stearns |
| 5,921,892 | A | 7/1999 | Easton |
| 5,921,896 | A | 7/1999 | Boland |
| 5,925,001 | A | 7/1999 | Hoyt et al. |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,575 | A | 8/1999 | Stearns |
| 5,940,502 | A | 8/1999 | Hirai et al. |
| 5,940,911 | A | 8/1999 | Wang |
| 5,941,807 | A | 8/1999 | Cassidy |
| 5,943,794 | A | 8/1999 | Gelsomini |
| 5,944,641 | A | 8/1999 | Habing |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,957,814 | A | 9/1999 | Eschenbach |
| 5,961,423 | A | 10/1999 | Sellers |
| 5,961,430 | A | 10/1999 | Zuckerman et al. |
| 5,967,944 | A | 10/1999 | Vittone et al. |
| 5,967,954 | A | 10/1999 | Habing |
| 5,967,955 | A | 10/1999 | Westfall et al. |
| 5,971,902 | A | 10/1999 | Robertson et al. |
| 5,976,039 | A | 11/1999 | Epel et al. |
| 5,976,061 | A | 11/1999 | Moon et al. |
| 5,980,430 | A | 11/1999 | Wang |
| 5,980,432 | A | 11/1999 | Ahman |
| 5,984,798 | A | 11/1999 | Gilmour |
| 5,984,839 | A | 11/1999 | Corkum |
| 5,989,161 | A | 11/1999 | Wang et al. |
| 5,989,163 | A | 11/1999 | Rodgers, Jr. |
| 5,989,168 | A | 11/1999 | See |
| 5,991,143 | A | 11/1999 | Wright et al. |
| 5,993,358 | A | 11/1999 | Gureghian et al. |
| 5,993,359 | A | 11/1999 | Eschenbach |
| 5,993,362 | A | 11/1999 | Ghobadi |
| 5,997,447 | A | 12/1999 | Giannelli et al. |
| 5,997,450 | A | 12/1999 | Wilkinson |
| 6,003,481 | A | 12/1999 | Pischinger et al. |
| 6,004,244 | A | 12/1999 | Simonson |
| 6,006,379 | A | 12/1999 | Hensley |
| 6,010,432 | A | 1/2000 | Vawter |
| 6,012,591 | A | 1/2000 | Brandenberg |
| 6,012,772 | A | 1/2000 | Conde et al. |
| 6,013,011 | A | 1/2000 | Moore et al. |
| 6,015,367 | A | 1/2000 | Scaramucci |
| 6,015,368 | A | 1/2000 | Clem |
| 6,027,429 | A | 2/2000 | Daniels |
| 6,027,430 | A | 2/2000 | Stearns et al. |
| 6,027,432 | A | 2/2000 | Cheng |
| 6,029,858 | A | 2/2000 | Srokose |
| 6,030,320 | A | 2/2000 | Stearns |
| 6,030,321 | A | 2/2000 | Fuentes |
| 6,030,323 | A | 2/2000 | Fontenot |
| 6,033,344 | A | 3/2000 | Trulaske et al. |
| 6,033,347 | A | 3/2000 | Dalebout et al. |
| 6,033,350 | A | 3/2000 | Krull |
| 6,036,622 | A | 3/2000 | Gordon |
| 6,042,512 | A | 3/2000 | Eschenbach |
| 6,042,514 | A | 3/2000 | Abelbeck |
| 6,042,515 | A | 3/2000 | Wang |
| 6,042,516 | A | 3/2000 | Norton |
| 6,042,518 | A | 3/2000 | Hildebrandt et al. |
| 6,042,523 | A | 3/2000 | Graham |
| 6,045,487 | A | 4/2000 | Miller |
| 6,045,488 | A | 4/2000 | Eschenbach |
| 6,045,490 | A | 4/2000 | Shafer |
| 6,045,491 | A | 4/2000 | McNergney |
| 6,050,920 | A | 4/2000 | Ehrenfried |
| 6,050,921 | A | 4/2000 | Wang |
| 6,050,922 | A | 4/2000 | Wang |
| 6,050,923 | A | 4/2000 | Yu |
| 6,053,844 | A | 4/2000 | Clem |
| 6,053,847 | A | 4/2000 | Stearns et al. |
| 6,053,848 | A | 4/2000 | Eschenbach |
| 6,055,747 | A | 5/2000 | Lombardino |
| 6,056,678 | A | 5/2000 | Giannelli et al. |
| 6,059,692 | A | 5/2000 | Hickman |
| 6,059,695 | A | 5/2000 | Hung |
| 6,063,009 | A | 5/2000 | Stearns |
| 6,066,075 | A | 5/2000 | Poulton |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,080,091 | A | 6/2000 | Habing et al. |
| 6,086,520 | A | 7/2000 | Rodriquez |
| 6,090,014 | A | 7/2000 | Eschenbach |
| 6,090,016 | A | 7/2000 | Kuo |
| 6,095,951 | A | 8/2000 | Skowronski et al. |
| 6,099,439 | A | 8/2000 | Ryan et al. |
| 6,102,412 | A | 8/2000 | Staffaroni |
| 6,102,832 | A | 8/2000 | Tani |
| 6,110,076 | A | 8/2000 | Hurt |
| 6,110,077 | A | 8/2000 | Yu |

(56) References Cited

U.S. PATENT DOCUMENTS

| | | | |
|---|---|---|---|
| 6,113,188 | A | 9/2000 | Stewart et al. |
| 6,113,522 | A | 9/2000 | Montgomery |
| 6,117,049 | A | 9/2000 | Lowe |
| 6,120,421 | A | 9/2000 | Kuo |
| 6,123,646 | A | 9/2000 | Colassi |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,129,962 | A | 10/2000 | Quigley et al. |
| 6,132,340 | A | 10/2000 | Wang |
| 6,135,924 | A | 10/2000 | Gibbs et al. |
| 6,135,925 | A | 10/2000 | Liu |
| 6,142,870 | A | 11/2000 | Wada et al. |
| 6,142,913 | A | 11/2000 | Ewert |
| 6,142,914 | A | 11/2000 | Crawford et al. |
| 6,142,915 | A | 11/2000 | Eschenbach |
| 6,146,315 | A | 11/2000 | Schonenberger |
| 6,149,551 | A | 11/2000 | Pyles et al. |
| 6,149,552 | A | 11/2000 | Chen |
| 6,152,856 | A | 11/2000 | Studor et al. |
| 6,152,859 | A | 11/2000 | Stearns |
| 6,162,183 | A | 12/2000 | Hoover |
| 6,163,451 | A | 12/2000 | Chiu |
| 6,165,107 | A | 12/2000 | Birrell |
| 6,168,551 | B1 | 1/2001 | Mcguinness |
| 6,171,216 | B1 | 1/2001 | Wang |
| 6,174,267 | B1 | 1/2001 | Dalebout |
| 6,174,268 | B1 | 1/2001 | Novak |
| 6,176,814 | B1 | 1/2001 | Ryan et al. |
| 6,179,753 | B1 | 1/2001 | Barker et al. |
| 6,181,647 | B1 | 1/2001 | Tipton et al. |
| 6,183,397 | B1 | 2/2001 | Stearns et al. |
| 6,186,290 | B1 | 2/2001 | Carlson |
| 6,186,460 | B1 | 2/2001 | Lin |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,635 | B1 | 2/2001 | Webber et al. |
| 6,203,474 | B1 | 3/2001 | Jones |
| 6,206,795 | B1 | 3/2001 | Ou |
| 6,210,305 | B1 | 4/2001 | Eschenbach |
| 6,213,919 | B1 | 4/2001 | Wang |
| 6,215,870 | B1 | 4/2001 | Hirai et al. |
| 6,217,487 | B1 | 4/2001 | Reinert |
| 6,220,990 | B1 | 4/2001 | Crivello |
| 6,220,995 | B1 | 4/2001 | Chen |
| 6,224,516 | B1 | 5/2001 | Disch |
| 6,224,519 | B1 | 5/2001 | Doolittle |
| 6,230,047 | B1 | 5/2001 | McHugh |
| 6,230,460 | B1 | 5/2001 | Huyett |
| 6,231,482 | B1 | 5/2001 | Thompson |
| 6,231,946 | B1 | 5/2001 | Brown, Jr. et al. |
| 6,234,935 | B1 | 5/2001 | Chu |
| 6,234,936 | B1 | 5/2001 | Wang |
| 6,237,583 | B1 | 5/2001 | Ripley et al. |
| 6,238,323 | B1 | 5/2001 | Simonson |
| 6,241,638 | B1 | 6/2001 | Hurt |
| 6,244,988 | B1 | 6/2001 | Delman |
| 6,244,992 | B1 | 6/2001 | James |
| 6,245,001 | B1 | 6/2001 | Siaperas |
| 6,251,047 | B1 | 6/2001 | Stearns et al. |
| 6,251,048 | B1 | 6/2001 | Kaufman |
| 6,254,514 | B1 | 7/2001 | Maresh et al. |
| 6,254,515 | B1 | 7/2001 | Carman et al. |
| 6,261,209 | B1 | 7/2001 | Coody |
| 6,264,586 | B1 | 7/2001 | Webber |
| 6,267,710 | B1 | 7/2001 | Liu |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,896 | B1 | 9/2001 | Grunfeld |
| 6,287,240 | B1 | 9/2001 | Trabbic |
| 6,293,375 | B1 | 9/2001 | Chen |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,312,363 | B1 | 11/2001 | Watterson et al. |
| 6,314,667 | B1 | 11/2001 | Rife et al. |
| 6,315,486 | B1 | 11/2001 | Lunz |
| 6,322,059 | B1 | 11/2001 | Kelm et al. |
| 6,322,481 | B1 | 11/2001 | Krull |
| 6,325,745 | B1 | 12/2001 | Yu |
| 6,325,746 | B1 | 12/2001 | Wang |
| 6,328,676 | B1 | 12/2001 | Alessandri |
| 6,328,677 | B1 | 12/2001 | Drapeau |
| 6,334,624 | B1 | 1/2002 | Giglio |
| 6,344,986 | B1 | 2/2002 | Jain et al. |
| 6,347,603 | B1 | 2/2002 | Felger |
| 6,348,028 | B1 | 2/2002 | Cragg |
| 6,350,218 | B1 | 2/2002 | Dalebout et al. |
| 6,352,494 | B2 | 3/2002 | McAlonan |
| 6,357,077 | B1 | 3/2002 | Jones, Jr. et al. |
| 6,361,476 | B1 | 3/2002 | Eschenbach |
| 6,368,252 | B1 | 4/2002 | Stearns |
| 6,368,254 | B1 | 4/2002 | Wall |
| 6,371,738 | B2 | 4/2002 | Jones |
| 6,371,895 | B1 | 4/2002 | Endelman et al. |
| 6,375,580 | B1 | 4/2002 | Schmidt |
| 6,379,289 | B1 | 4/2002 | Gossie |
| 6,382,627 | B1 | 5/2002 | Lundberg |
| 6,383,120 | B1 | 5/2002 | Lo |
| 6,387,015 | B1 | 5/2002 | Watson |
| 6,387,016 | B1 | 5/2002 | Lo |
| 6,390,953 | B1 | 5/2002 | Maresh |
| 6,390,955 | B1 | 5/2002 | Wang |
| 6,394,239 | B1 | 5/2002 | Carlson |
| 6,397,797 | B1 | 6/2002 | Kolmanovsky et al. |
| 6,398,695 | B2 | 6/2002 | Miller |
| 6,402,666 | B2 | 6/2002 | Krull |
| 6,409,632 | B1 | 6/2002 | Eschenbach |
| 6,409,633 | B1 | 6/2002 | Abelbeck |
| 6,413,197 | B2 | 7/2002 | McKechnie et al. |
| 6,416,442 | B1 | 7/2002 | Stearns et al. |
| 6,416,444 | B1 | 7/2002 | Lim |
| 6,419,611 | B1 | 7/2002 | Levine et al. |
| 6,422,976 | B1 | 7/2002 | Eschenbach |
| 6,422,977 | B1 | 7/2002 | Eschenbach |
| 6,422,983 | B1 | 7/2002 | Weck |
| 6,428,449 | B1 | 8/2002 | Apseloff |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,440,013 | B1 | 8/2002 | Brown |
| 6,440,042 | B2 | 8/2002 | Eschenbach |
| 6,443,875 | B1 | 9/2002 | Golen, Jr. et al. |
| 6,447,430 | B1 | 9/2002 | Webb et al. |
| 6,450,284 | B1 | 9/2002 | Sakyo et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,461,275 | B1 | 10/2002 | Wang et al. |
| 6,461,279 | B1 | 10/2002 | Kuo |

(56) References Cited

U.S. PATENT DOCUMENTS 6,466,460 B1 10/2002 Rein et al.
6,468,189 B2 10/2002 Alessandri
6,471,622 B1 10/2002 Hammer et al.
6,475,121 B2 11/2002 Wang
6,478,721 B1 11/2002 Hunter
6,482,128 B1 11/2002 Michalow
6,482,130 B1 11/2002 Pasero et al.
6,482,132 B2 11/2002 Eschenbach
6,485,397 B1 11/2002 Manderbacka
6,488,020 B1 12/2002 Rosas-Magallan
6,491,610 B1 12/2002 Henn
6,494,814 B1 12/2002 Wang
6,494,817 B2 12/2002 Lake
6,500,097 B1 12/2002 Hall
6,503,173 B2 1/2003 Clem
6,505,503 B1 1/2003 Teresi et al.
6,513,532 B2 2/2003 Mault et al.
6,513,669 B2 2/2003 Ozawa et al.
6,514,180 B1 2/2003 Rawls
6,520,891 B1 2/2003 Stephens, Jr.
6,527,674 B1 3/2003 Clem
6,527,678 B1 3/2003 Wang
6,527,685 B2 3/2003 Endelman et al.
6,527,796 B1 3/2003 Magovern
6,530,864 B1 3/2003 Parks
6,533,707 B2 3/2003 Wang
6,537,184 B2 3/2003 Kim
6,539,931 B2 4/2003 Trajkovic et al.
6,543,247 B2 4/2003 Strauss
6,544,146 B1 4/2003 Stearns et al.
6,547,701 B1 4/2003 Eschenbach
6,547,702 B1 4/2003 Heidecke
6,551,218 B2 4/2003 Goh
6,551,223 B2 4/2003 Cheng
6,554,749 B2 4/2003 Iund et al.
6,558,299 B1 5/2003 Slattery
6,558,301 B1 5/2003 Jackson
6,561,960 B2 5/2003 Webber
6,563,489 B1 5/2003 Latypov et al.
6,569,061 B2 5/2003 Stearns et al.
6,569,062 B2 5/2003 Wang
6,572,511 B1 6/2003 Volpe
6,572,512 B2 6/2003 Anderson et al.
6,572,513 B1 6/2003 Whan-Tong et al.
6,575,878 B1 6/2003 Choy
6,579,210 B1 6/2003 Stearns et al.
6,579,211 B2 6/2003 Wu
6,582,342 B2 6/2003 Kaufman
6,582,344 B2 6/2003 Tang
6,585,624 B1 7/2003 Chen
6,585,626 B2 7/2003 McBride
6,589,138 B2 7/2003 Dyer et al.
6,592,502 B1 7/2003 Phillips
6,599,223 B2 7/2003 Wang
6,601,016 B1 7/2003 Brown et al.
6,601,358 B2 8/2003 Panatta
6,601,825 B2 8/2003 Bressner et al.
6,604,008 B2 8/2003 Chudley et al.
6,605,020 B1 8/2003 Huang
6,609,478 B2 8/2003 Del Valle
6,610,063 B2 8/2003 Kumar et al.
6,612,969 B2 9/2003 Eschenbach
6,612,971 B1 9/2003 Morris
6,619,681 B2 9/2003 Gutierrez
6,620,079 B2 9/2003 Kuo
6,623,407 B2 9/2003 Novak
6,623,409 B1 9/2003 Abelbeck
6,626,799 B2 9/2003 Watterson et al.
6,626,802 B1 9/2003 Rodgers, Jr.
6,626,803 B1 9/2003 Oglesby et al.
6,629,902 B2 10/2003 Murphy et al.
6,629,909 B1 10/2003 Stearns et al.
6,629,910 B1 10/2003 Krull
6,632,161 B1 10/2003 Nir
6,634,996 B2 10/2003 Jacobsen
6,637,811 B2 10/2003 Zheng
6,637,818 B2 10/2003 Williams
6,645,125 B1 11/2003 Stearns et al.
6,645,126 B1 11/2003 Martin et al.
6,645,130 B2 11/2003 Webber
6,648,800 B2 11/2003 Stearns et al.
6,648,801 B2 11/2003 Stearns et al.
6,648,802 B2 11/2003 Ware
6,652,424 B2 11/2003 Dalebout
6,652,425 B1 11/2003 Martin et al.
6,652,429 B2 11/2003 Bushnell
6,660,949 B2 12/2003 Kamino et al.
6,661,136 B1 12/2003 Lee
6,663,127 B2 12/2003 Miller
6,663,498 B2 12/2003 Stipan
6,663,500 B2 12/2003 Huang
6,666,800 B2 12/2003 Krull
6,666,801 B1 12/2003 Michalow
6,668,678 B1 12/2003 Baba et al.
6,669,600 B2 12/2003 Warner
6,669,609 B2 12/2003 Gerschefske et al.
6,671,975 B2 1/2004 Hennessey
6,672,991 B2 1/2004 O'Malley
6,672,992 B1 1/2004 Lo et al.
6,672,994 B1 1/2004 Stearns et al.
6,676,530 B2 1/2004 Lochtefeld
6,676,572 B2 1/2004 Wang
6,676,579 B1 1/2004 Lin
6,679,816 B1 1/2004 Krull
6,679,820 B2 1/2004 Barkus et al.
6,681,704 B1 1/2004 Brookhiser
6,681,728 B2 1/2004 Haghgooie
6,682,460 B2 1/2004 Lo
6,682,461 B2 1/2004 Wang
6,685,169 B2 2/2004 Shim
6,685,601 B1 2/2004 Knapp
6,685,602 B2 2/2004 Colosky, Jr. et al.
6,685,607 B1 2/2004 Olson
6,689,019 B2 2/2004 Ohrt et al.
6,689,020 B2 2/2004 Stearns
6,689,075 B2 2/2004 West
6,695,694 B2 2/2004 Ishikawa et al.
6,698,110 B1 3/2004 Robbins
6,699,159 B2 3/2004 Rouse
6,699,162 B2 3/2004 Chen
6,702,719 B1 3/2004 Brown et al.
6,705,977 B1 3/2004 Ziak
6,708,427 B2 3/2004 Sussmann et al.
6,712,737 B1 3/2004 Nusbaum
6,716,142 B2 4/2004 Kuo
6,716,144 B1 4/2004 Shifferaw
6,719,667 B2 4/2004 Wong et al.
6,719,669 B1 4/2004 Wang
6,723,413 B2 4/2004 Walters
6,726,600 B2 4/2004 Miller
6,726,601 B1 4/2004 Beutel
6,726,602 B2 4/2004 Chang
6,730,002 B2 5/2004 Hald et al.
6,733,423 B1 5/2004 Chang
6,733,424 B2 5/2004 Krull
6,736,360 B1 5/2004 Buczek
6,738,274 B2 5/2004 Prasad et al.
6,740,009 B1 5/2004 Hall
6,741,052 B2 5/2004 Fitzgibbon
6,743,153 B2 6/2004 Watterson et al.
6,746,371 B1 6/2004 Brown et al.
6,747,427 B1 6/2004 Carson
6,749,542 B2 6/2004 Wu
6,758,790 B1 7/2004 Ellis
6,758,791 B1 7/2004 Kuo
6,758,792 B1 7/2004 Chang
6,761,387 B2 7/2004 Sloss
6,761,667 B1 7/2004 Cutler et al.
6,764,429 B1 7/2004 Michalow
6,764,430 B1 7/2004 Fencel
6,764,431 B2 7/2004 Yoss
6,767,314 B2 7/2004 Thompson
6,770,015 B2 8/2004 Simonson
6,776,740 B1 8/2004 Anderson et al.

(56) References Cited

U.S. PATENT DOCUMENTS

| | | | |
|---|---|---|---|
| 6,778,938 | B1 | 8/2004 | Ng et al. |
| 6,783,134 | B2 | 8/2004 | Geary |
| 6,783,482 | B2 | 8/2004 | Oglesby et al. |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,793,607 | B2 | 9/2004 | Neil |
| 6,793,609 | B1 | 9/2004 | Fan |
| 6,796,159 | B2 | 9/2004 | Kelm et al. |
| 6,796,927 | B2 | 9/2004 | Toyama |
| 6,800,050 | B2 | 10/2004 | Moavro |
| 6,807,869 | B2 | 10/2004 | Farringdon et al. |
| 6,808,458 | B1 | 10/2004 | Jung |
| 6,808,475 | B2 | 10/2004 | Kehrbaum |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,821,230 | B2 | 11/2004 | Dalebout et al. |
| 6,824,210 | B2 | 11/2004 | Zheng |
| 6,824,502 | B1 | 11/2004 | Huang |
| 6,830,540 | B2 | 12/2004 | Watterson |
| 6,830,541 | B2 | 12/2004 | Wu |
| 6,835,166 | B1 | 12/2004 | Stearns et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,842,928 | B2 | 1/2005 | Yang et al. |
| 6,843,732 | B1 | 1/2005 | Huang |
| 6,843,757 | B2 | 1/2005 | Pan et al. |
| 6,846,272 | B2 | 1/2005 | Rosenow et al. |
| 6,849,032 | B2 | 2/2005 | Chu |
| 6,852,068 | B2 | 2/2005 | Ogawa |
| 6,852,069 | B2 | 2/2005 | Park |
| 6,855,093 | B2 | 2/2005 | Anderson et al. |
| 6,855,097 | B2 | 2/2005 | Krull |
| 6,857,993 | B2 | 2/2005 | Yeh |
| 6,860,836 | B1 | 3/2005 | Wu |
| 6,860,839 | B1 | 3/2005 | Dice |
| 6,866,141 | B2 | 3/2005 | Saeki |
| 6,872,168 | B2 | 3/2005 | Wang et al. |
| 6,872,175 | B2 | 3/2005 | Lin |
| 6,875,157 | B1 | 4/2005 | Wang |
| 6,875,160 | B2 | 4/2005 | Watterson et al. |
| 6,878,099 | B2 | 4/2005 | Corbalis et al. |
| 6,878,101 | B2 | 4/2005 | Colley |
| 6,880,416 | B2 | 4/2005 | Koch |
| 6,880,487 | B2 | 4/2005 | Reinkensmeyer et al. |
| 6,881,176 | B2 | 4/2005 | Oishi et al. |
| 6,887,185 | B1 | 5/2005 | Kuo |
| 6,887,190 | B1 | 5/2005 | Azari |
| 6,893,383 | B1 | 5/2005 | Chang et al. |
| 6,896,645 | B1 | 5/2005 | Krull |
| 6,899,657 | B2 | 5/2005 | Chuang |
| 6,899,659 | B2 | 5/2005 | Anderson et al. |
| 6,902,513 | B1 | 6/2005 | Mcclure |
| 6,902,515 | B2 | 6/2005 | Howell et al. |
| 6,905,446 | B2 | 6/2005 | Greenland |
| 6,908,416 | B2 | 6/2005 | Mercado et al. |
| 6,908,417 | B2 | 6/2005 | Jackson |
| 6,910,991 | B2 | 6/2005 | Matsumoto |
| 6,913,562 | B2 | 7/2005 | Chen |
| 6,913,563 | B2 | 7/2005 | Chen |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,920,947 | B2 | 7/2005 | Kamen et al. |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,926,644 | B2 | 8/2005 | Chen |
| 6,926,646 | B1 | 8/2005 | Nguyen |
| 6,932,745 | B1 | 8/2005 | Ellis |
| 6,944,294 | B2 | 9/2005 | Tsay |
| 6,945,912 | B2 | 9/2005 | Levi |
| 6,945,917 | B1 | 9/2005 | Baatz |
| 6,949,053 | B1 | 9/2005 | Stearns |
| 6,949,054 | B1 | 9/2005 | Stearns |
| 6,953,418 | B1 | 10/2005 | Chen |
| 6,953,424 | B2 | 10/2005 | Kusumoto et al. |
| 6,964,632 | B1 | 11/2005 | Ko |
| 6,966,872 | B2 | 11/2005 | Eschenbach |
| 6,974,404 | B1 | 12/2005 | Watterson et al. |
| 6,976,698 | B2 | 12/2005 | Kuiken |
| 6,979,283 | B2 | 12/2005 | Pan |
| 6,991,588 | B1 | 1/2006 | Adams |
| 6,993,270 | B2 | 1/2006 | Yoshioka et al. |
| 6,994,306 | B1 | 2/2006 | Sweere et al. |
| 6,994,657 | B1 | 2/2006 | Eschenbach |
| 6,997,852 | B2 | 2/2006 | Watterson et al. |
| 6,997,856 | B1 | 2/2006 | Krull |
| 7,001,288 | B2 | 2/2006 | Harrell |
| 7,003,122 | B2 | 2/2006 | Chen |
| 7,003,828 | B2 | 2/2006 | Roussy |
| 7,004,271 | B1 | 2/2006 | Kamen et al. |
| 7,004,887 | B2 | 2/2006 | Pan et al. |
| 7,004,888 | B1 | 2/2006 | Weng |
| 7,008,352 | B2 | 3/2006 | Grossi |
| 7,008,359 | B2 | 3/2006 | Fan et al. |
| 7,009,613 | B2 | 3/2006 | Goden |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,014,599 | B2 | 3/2006 | Ashley |
| 7,022,047 | B2 | 4/2006 | Cohen et al. |
| 7,022,048 | B1 | 4/2006 | Fernandez |
| 7,022,049 | B2 | 4/2006 | Ryan et al. |
| 7,022,051 | B2 | 4/2006 | Ota |
| 7,032,870 | B2 | 4/2006 | Sweere et al. |
| 7,033,176 | B2 | 4/2006 | Feldman |
| 7,033,269 | B2 | 4/2006 | Namba et al. |
| 7,033,306 | B2 | 4/2006 | Graber |
| 7,037,241 | B2 | 5/2006 | Kuo |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,044,891 | B1 | 5/2006 | Rivera |
| 7,047,817 | B2 | 5/2006 | Lanham |
| 7,052,426 | B2 | 5/2006 | Battat et al. |
| 7,052,440 | B2 | 5/2006 | Pyles et al. |
| 7,052,442 | B2 | 5/2006 | Watterson |
| 7,052,444 | B2 | 5/2006 | Webber |
| 7,052,446 | B2 | 5/2006 | Morris et al. |
| 7,055,899 | B2 | 6/2006 | Zhurong et al. |
| 7,060,005 | B2 | 6/2006 | Carlsen et al. |
| 7,060,006 | B1 | 6/2006 | Watterson et al. |
| 7,060,007 | B2 | 6/2006 | Juva |
| 7,060,008 | B2 | 6/2006 | Watterson et al. |
| 7,060,012 | B2 | 6/2006 | Howell et al. |
| 7,070,415 | B2 | 7/2006 | Hojo et al. |
| 7,070,542 | B2 | 7/2006 | Reyes et al. |
| 7,070,545 | B2 | 7/2006 | Lull et al. |
| 7,073,852 | B1 | 7/2006 | Zheng |
| 7,077,788 | B2 | 7/2006 | Chang |
| 7,077,791 | B2 | 7/2006 | Krull |
| 7,081,069 | B2 | 7/2006 | Hsu |
| 7,081,073 | B1 | 7/2006 | Smith |
| 7,082,703 | B2 | 8/2006 | Greene et al. |
| 7,083,546 | B2 | 8/2006 | Zillig |
| 7,083,582 | B2 | 8/2006 | Chen |
| 7,086,994 | B2 | 8/2006 | Turak et al. |
| 7,086,995 | B2 | 8/2006 | Reyes |
| 7,090,621 | B2 | 8/2006 | Loane |
| 7,090,622 | B2 | 8/2006 | Hetrick |
| 7,097,593 | B2 | 8/2006 | Chang |
| 7,100,517 | B1 | 9/2006 | Godwin |
| 7,101,319 | B1 | 9/2006 | Potts |

(56) References Cited

U.S. PATENT DOCUMENTS

| | | | |
|---|---|---|---|
| 7,101,322 | B2 | 9/2006 | Carle |
| 7,101,330 | B2 | 9/2006 | Elbaz et al. |
| 7,104,926 | B2 | 9/2006 | Carlson |
| 7,104,930 | B2 | 9/2006 | Lo et al. |
| 7,104,937 | B2 | 9/2006 | Arbuckle |
| 7,108,641 | B2 | 9/2006 | Pertegaz-Esteban |
| 7,108,659 | B2 | 9/2006 | Ross et al. |
| 7,115,073 | B2 | 10/2006 | Nizamuddin |
| 7,125,371 | B2 | 10/2006 | Henderson |
| 7,132,939 | B2 | 11/2006 | Tyndall et al. |
| 7,140,487 | B2 | 11/2006 | Motoda |
| 7,140,626 | B1 | 11/2006 | Keay |
| 7,141,005 | B2 | 11/2006 | Wu |
| 7,141,008 | B2 | 11/2006 | Krull et al. |
| 7,147,591 | B2 | 12/2006 | McAvoy |
| 7,156,776 | B2 | 1/2007 | Maser |
| 7,163,488 | B2 | 1/2007 | Anders |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,172,531 | B2 | 2/2007 | Rodgers, Jr. |
| 7,175,193 | B2 | 2/2007 | Wu |
| 7,179,204 | B2 | 2/2007 | Anderson et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,186,189 | B2 | 3/2007 | Huang |
| 7,188,439 | B2 | 3/2007 | DiBenedetto et al. |
| 7,189,190 | B2 | 3/2007 | Lamar et al. |
| 7,192,387 | B2 | 3/2007 | Mendel |
| 7,192,388 | B2 | 3/2007 | Dalebout et al. |
| 7,195,568 | B2 | 3/2007 | Huang |
| 7,196,491 | B2 | 3/2007 | Mayhew et al. |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,211,029 | B2 | 5/2007 | Kau |
| 7,214,167 | B2 | 5/2007 | Stearns |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,216 | B1 | 5/2007 | McBride |
| 7,225,694 | B2 | 6/2007 | Said |
| 7,226,402 | B1 | 6/2007 | Joya |
| 7,234,200 | B2 | 6/2007 | Chase |
| 7,235,942 | B2 | 6/2007 | Nagaoka et al. |
| 7,238,147 | B2 | 7/2007 | Mills et al. |
| 7,247,128 | B2 | 7/2007 | Oga |
| 7,250,022 | B2 | 7/2007 | Dalebout |
| 7,257,468 | B1 | 8/2007 | Costa et al. |
| 7,258,039 | B2 | 8/2007 | Lin |
| 7,258,651 | B2 | 8/2007 | Clarke |
| 7,260,950 | B2 | 8/2007 | Choi et al. |
| 7,264,554 | B2 | 9/2007 | Bentley |
| 7,269,038 | B2 | 9/2007 | Shekhawat |
| 7,278,934 | B2 | 10/2007 | McBride et al. |
| 7,278,955 | B2 | 10/2007 | Giannelli et al. |
| 7,278,966 | B2 | 10/2007 | Hjelt et al. |
| 7,279,868 | B2 | 10/2007 | Lanni |
| 7,285,075 | B2 | 10/2007 | Cutler et al. |
| 7,287,770 | B2 | 10/2007 | Drabant et al. |
| 7,290,760 | B1 | 11/2007 | Lindsay |
| 7,291,096 | B2 | 11/2007 | Ho |
| 7,291,100 | B2 | 11/2007 | Dodge |
| 7,292,151 | B2 | 11/2007 | Ferguson |
| 7,293,510 | B1 | 11/2007 | Siao |
| 7,294,094 | B1 | 11/2007 | Howle |
| 7,294,100 | B2 | 11/2007 | Bull |
| 7,303,508 | B2 | 12/2007 | Toyama et al. |
| 7,303,510 | B2 | 12/2007 | Gebhardt |
| 7,311,640 | B2 | 12/2007 | Baatz |
| 7,316,633 | B2 | 1/2008 | Liao et al. |
| 7,319,457 | B2 | 1/2008 | Lin et al. |
| 7,322,653 | B2 | 1/2008 | Dragusin |
| 7,322,907 | B2 | 1/2008 | Bowser |
| 7,329,212 | B2 | 2/2008 | Roque |
| 7,331,227 | B2 | 2/2008 | Kang et al. |
| 7,334,350 | B2 | 2/2008 | Ellis, III |
| 7,335,135 | B2 | 2/2008 | Wang |
| 7,335,139 | B2 | 2/2008 | Bartholomew et al. |
| 7,335,140 | B2 | 2/2008 | Webber et al. |
| 7,335,147 | B2 | 2/2008 | Jones |
| 7,344,481 | B2 | 3/2008 | Watterson et al. |
| 7,346,935 | B1 | 3/2008 | Patterson |
| 7,347,806 | B2 | 3/2008 | Nakano et al. |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,122 | B2 | 4/2008 | Porth |
| 7,361,125 | B2 | 4/2008 | Webber et al. |
| 7,362,016 | B2 | 4/2008 | Cheng |
| 7,364,538 | B2 | 4/2008 | Aucamp |
| 7,366,921 | B2 | 4/2008 | Ranganathan |
| 7,367,926 | B2 | 5/2008 | Clark |
| 7,367,957 | B2 | 5/2008 | Huang et al. |
| 7,369,121 | B2 | 5/2008 | Lane |
| 7,374,522 | B2 | 5/2008 | Arnold |
| 7,377,881 | B2 | 5/2008 | Moon |
| 7,377,882 | B2 | 5/2008 | Watterson |
| 7,381,161 | B2 | 6/2008 | Ellis |
| 7,384,013 | B2 | 6/2008 | Yen |
| 7,393,308 | B1 | 7/2008 | Huang |
| 7,402,145 | B1 | 7/2008 | Woggon |
| 7,404,232 | B2 | 7/2008 | Chase |
| 7,410,449 | B2 | 8/2008 | Yeh |
| 7,413,532 | B1 | 8/2008 | Monsrud et al. |
| 7,425,189 | B1 | 9/2008 | Eschenbach |
| 7,428,760 | B2 | 9/2008 | McCrimmon |
| 7,429,236 | B2 | 9/2008 | Dalebout et al. |
| 7,432,677 | B2 | 10/2008 | Heydt et al. |
| 7,435,202 | B2 | 10/2008 | Daly et al. |
| 7,435,203 | B2 | 10/2008 | Anderson et al. |
| 7,435,205 | B2 | 10/2008 | Reyes et al. |
| 7,455,621 | B1 | 11/2008 | Anthony |
| 7,455,626 | B2 | 11/2008 | Trevino et al. |
| 7,455,628 | B1 | 11/2008 | Stearns |
| 7,461,825 | B2 | 12/2008 | Olivera |
| 7,462,135 | B2 | 12/2008 | Lo |
| 7,470,234 | B1 | 12/2008 | Elhag et al. |
| 7,473,211 | B2 | 1/2009 | Lee |
| 7,475,613 | B2 | 1/2009 | Bailey |
| 7,485,076 | B2 | 2/2009 | Lee |
| 7,488,277 | B1 | 2/2009 | Knapp |
| 7,491,154 | B2 | 2/2009 | Yonehana et al. |
| 7,494,450 | B2 | 2/2009 | Solomon |
| 7,494,454 | B2 | 2/2009 | Sheets |
| 7,497,784 | B2 | 3/2009 | Henry |
| 7,497,806 | B2 | 3/2009 | Duncan et al. |
| 7,507,183 | B2 | 3/2009 | Anderson |
| 7,507,187 | B2 | 3/2009 | Dyer et al. |
| 7,507,189 | B2 | 3/2009 | Krull |
| 7,510,508 | B2 | 3/2009 | Santomassimo et al. |
| 7,510,511 | B2 | 3/2009 | Von Detten |
| 7,511,710 | B2 | 3/2009 | Barrett |
| 7,517,303 | B2 | 4/2009 | Crawford et al. |
| 7,520,840 | B2 | 4/2009 | Shifferaw |
| 7,524,272 | B2 | 4/2009 | Bruck et al. |
| 7,525,293 | B1 | 4/2009 | Notohamiprodjo et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,552 | B2 | 5/2009 | Dalebout et al. |

(56) References Cited

U.S. PATENT DOCUMENTS

| | | | |
|---|---|---|---|
| 7,540,828 | B2 | 6/2009 | Watterson et al. |
| 7,540,829 | B1 | 6/2009 | Lin |
| 7,544,153 | B2 | 6/2009 | Trevino et al. |
| 7,547,255 | B2 | 6/2009 | Lochtefeld et al. |
| 7,549,938 | B2 | 6/2009 | Leighton et al. |
| 7,549,947 | B2 | 6/2009 | Hickman et al. |
| 7,553,260 | B2 | 6/2009 | Piaget et al. |
| 7,553,262 | B2 | 6/2009 | Piane, Jr. |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,563,203 | B2 | 7/2009 | Dalebout et al. |
| 7,563,205 | B2 | 7/2009 | Alling |
| 7,563,235 | B2 | 7/2009 | Der Meer |
| 7,569,000 | B2 | 8/2009 | Wang |
| 7,569,004 | B2 | 8/2009 | Kolomeir |
| 7,572,206 | B2 | 8/2009 | Wilkins et al. |
| 7,575,537 | B2 | 8/2009 | Ellis |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,588,520 | B2 | 9/2009 | Nalley |
| 7,591,770 | B2 | 9/2009 | Stewart et al. |
| 7,591,795 | B2 | 9/2009 | Whalen et al. |
| 7,594,873 | B2 | 9/2009 | Terao et al. |
| 7,594,877 | B2 | 9/2009 | Anderson et al. |
| 7,594,878 | B1 | 9/2009 | Joannou |
| 7,594,880 | B2 | 9/2009 | Webber |
| 7,601,101 | B2 | 10/2009 | Jackson et al. |
| 7,602,301 | B1 | 10/2009 | Stirling et al. |
| 7,604,571 | B2 | 10/2009 | Wilkins et al. |
| 7,604,572 | B2 | 10/2009 | Stanford |
| 7,604,573 | B2 | 10/2009 | Dalebout et al. |
| 7,608,015 | B2 | 10/2009 | Radow |
| 7,608,021 | B1 | 10/2009 | Nalley |
| 7,608,023 | B2 | 10/2009 | Casagrande |
| 7,608,028 | B2 | 10/2009 | Pertegaz-Esteban |
| 7,614,639 | B2 | 11/2009 | Tholkes et al. |
| 7,614,981 | B2 | 11/2009 | Cao |
| 7,614,991 | B2 | 11/2009 | Fox |
| 7,618,345 | B2 | 11/2009 | Corbalis et al. |
| 7,618,346 | B2 | 11/2009 | Crawford et al. |
| 7,618,350 | B2 | 11/2009 | Dalebout et al. |
| 7,621,850 | B2 | 11/2009 | Piaget et al. |
| 7,621,855 | B1 | 11/2009 | Krull |
| 7,625,314 | B2 | 12/2009 | Ungari |
| 7,625,315 | B2 | 12/2009 | Hickman |
| 7,625,319 | B2 | 12/2009 | Kang et al. |
| 7,628,730 | B1 | 12/2009 | Watterson et al. |
| 7,628,732 | B1 | 12/2009 | Porszasz et al. |
| 7,628,733 | B2 | 12/2009 | Donner |
| 7,630,201 | B2 | 12/2009 | Asahi |
| 7,637,847 | B1 | 12/2009 | Hickman |
| 7,637,850 | B2 | 12/2009 | Lin |
| 7,639,520 | B1 | 12/2009 | Zansky et al. |
| 7,645,212 | B2 | 1/2010 | Ashby et al. |
| 7,645,214 | B2 | 1/2010 | Lull |
| 7,645,215 | B2 | 1/2010 | Gordon |
| 7,645,218 | B2 | 1/2010 | Potok et al. |
| 7,647,196 | B2 | 1/2010 | Kahn et al. |
| 7,648,441 | B2 | 1/2010 | Silk |
| 7,648,443 | B2 | 1/2010 | Schenk |
| 7,648,446 | B2 | 1/2010 | Chiles et al. |
| 7,650,987 | B2 | 1/2010 | Taniguchi et al. |
| 7,651,442 | B2 | 1/2010 | Carlson |
| 7,651,450 | B2 | 1/2010 | Wehrell |
| 7,654,229 | B2 | 2/2010 | Smith |
| 7,654,938 | B2 | 2/2010 | Webber et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,665,794 | B2 | 2/2010 | Kachouh |
| 7,670,263 | B2 | 3/2010 | Ellis |
| 7,674,205 | B2 | 3/2010 | Dalebout et al. |
| 7,674,206 | B2 | 3/2010 | Jones |
| 7,677,518 | B2 | 3/2010 | Chouinard et al. |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,686,742 | B2 | 3/2010 | Tischler |
| 7,690,317 | B2 | 4/2010 | Beck et al. |
| 7,690,556 | B1 | 4/2010 | Kahn et al. |
| 7,691,031 | B2 | 4/2010 | Toyama et al. |
| 7,691,069 | B2 | 4/2010 | Adams |
| 7,695,406 | B2 | 4/2010 | Waters |
| 7,695,409 | B2 | 4/2010 | Helie et al. |
| 7,704,191 | B2 | 4/2010 | Smith et al. |
| 7,704,192 | B2 | 4/2010 | Dyer et al. |
| 7,704,199 | B2 | 4/2010 | Koch |
| 7,706,547 | B2 | 4/2010 | Luo |
| 7,708,668 | B2 | 5/2010 | Rodgers, Jr. |
| 7,708,670 | B2 | 5/2010 | Bowser |
| 7,708,672 | B2 | 5/2010 | Gibson et al. |
| 7,713,172 | B2 | 5/2010 | Watterson et al. |
| 7,713,177 | B2 | 5/2010 | Lo |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,829 | B2 | 5/2010 | Wang |
| 7,717,830 | B1 | 5/2010 | Charniga et al. |
| 7,722,503 | B1 | 5/2010 | Smith et al. |
| 7,722,507 | B2 | 5/2010 | Yoo |
| 7,722,509 | B2 | 5/2010 | Eder |
| 7,731,634 | B2 | 6/2010 | Stewart et al. |
| 7,731,635 | B2 | 6/2010 | Dyer |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,740,562 | B2 | 6/2010 | Jones |
| 7,740,563 | B2 | 6/2010 | Dalebout et al. |
| 7,741,975 | B2 | 6/2010 | Shum et al. |
| 7,745,716 | B1 | 6/2010 | Murphy |
| 7,749,137 | B2 | 7/2010 | Watt et al. |
| 7,749,138 | B2 | 7/2010 | Wang |
| 7,753,824 | B2 | 7/2010 | Wang |
| 7,753,830 | B1 | 7/2010 | Marsh et al. |
| 7,753,861 | B1 | 7/2010 | Kahn et al. |
| 7,757,346 | B2 | 7/2010 | Chase |
| 7,758,469 | B2 | 7/2010 | Dyer et al. |
| 7,758,470 | B2 | 7/2010 | Hirata et al. |
| 7,758,478 | B2 | 7/2010 | Golesh et al. |
| 7,761,212 | B2 | 7/2010 | Takebayashi |
| 7,762,935 | B2 | 7/2010 | Doble |
| 7,762,952 | B2 | 7/2010 | Lee et al. |
| 7,764,990 | B2 | 7/2010 | Martikka et al. |
| 7,766,797 | B2 | 8/2010 | Dalebout |
| 7,771,319 | B1 | 8/2010 | Lannon |
| 7,771,320 | B2 | 8/2010 | Riley et al. |
| 7,771,329 | B2 | 8/2010 | Dalebout et al. |
| 7,771,371 | B2 | 8/2010 | Avni |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,780,577 | B2 | 8/2010 | Arnold |
| 7,780,578 | B2 | 8/2010 | Packham |
| 7,785,232 | B2 | 8/2010 | Cole et al. |
| 7,789,800 | B1 | 9/2010 | Watterson et al. |
| 7,794,363 | B2 | 9/2010 | Wang |
| 7,795,824 | B2 | 9/2010 | Shen et al. |
| 7,805,186 | B2 | 9/2010 | Pulkkinen et al. |
| 7,806,006 | B2 | 10/2010 | Phillips et al. |
| 7,806,780 | B1 | 10/2010 | Plunkett |
| 7,806,805 | B2 | 10/2010 | Barufka et al. |
| 7,811,209 | B2 | 10/2010 | Crawford et al. |
| 7,815,549 | B2 | 10/2010 | Crawford et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,779 | B2 | 10/2010 | Chang |
| 7,825,319 | B2 | 11/2010 | Turner |
| 7,828,699 | B2 | 11/2010 | P Erez De Lazarraga |

(56) References Cited

U.S. PATENT DOCUMENTS 7,833,135 B2 11/2010 Radow
7,837,161 B2 11/2010 Chase
7,837,595 B2 11/2010 Rice
7,839,058 B1 11/2010 Churchill et al.
7,846,070 B2 12/2010 Oglesby et al.
7,850,514 B2 12/2010 Weber
7,850,537 B2 12/2010 Stern
7,854,690 B2 12/2010 Trevino et al.
7,862,475 B2 1/2011 Watterson
7,862,483 B2 1/2011 Hendrickson et al.
7,871,355 B2 1/2011 Yeh
7,871,357 B2 1/2011 Gibson et al.
7,873,849 B2 1/2011 Mucignat et al.
7,874,963 B2 1/2011 Grind
7,878,950 B1 2/2011 Bastian
7,878,956 B2 2/2011 Kadar
7,883,445 B2 2/2011 Olrik et al.
7,883,448 B2 2/2011 Wang
7,887,465 B2 2/2011 Uffelman
7,892,148 B1 2/2011 Stauffer et al.
7,892,149 B2 2/2011 Wu
7,892,150 B1 2/2011 Colley
7,892,155 B2 2/2011 Pearson et al.
7,892,159 B2 2/2011 McVay et al.
7,901,324 B2 3/2011 Kodama
7,901,325 B2 3/2011 Henderson
7,901,753 B2 3/2011 Carr
7,905,817 B2 3/2011 Giannascoli et al.
7,908,981 B2 3/2011 Agee
7,909,740 B2 3/2011 Dalebout et al.
7,914,420 B2 3/2011 Daly et al.
7,914,421 B2 3/2011 Weier et al.
7,918,768 B2 4/2011 Rogozinski
7,919,950 B2 4/2011 Uno et al.
7,922,635 B2 4/2011 Lull et al.
7,927,253 B2 4/2011 Vincent
7,927,257 B2 4/2011 Patel
7,927,267 B2 4/2011 Splane
7,931,563 B2 4/2011 Shaw et al.
7,938,751 B2 5/2011 Nicolas et al.
7,938,755 B1 5/2011 Dyer et al.
7,941,945 B2 5/2011 Gerber
7,942,783 B2 5/2011 Ochi
7,942,788 B2 5/2011 Wu
7,946,967 B2 5/2011 Berhanu
7,946,968 B2 5/2011 Kjellberg
7,949,295 B2 5/2011 Kumar et al.
7,951,046 B1 5/2011 Barber, Jr.
7,959,124 B2 6/2011 Phifer et al.
7,967,728 B2 6/2011 Zavadsky
7,967,730 B2 6/2011 Crawford et al.
7,972,245 B2 7/2011 Temple et al.
7,972,249 B1 7/2011 Napalan
7,976,437 B1 7/2011 Von Detten
7,978,081 B2 7/2011 Shears et al.
7,980,996 B2 7/2011 Hickman
7,985,164 B2 7/2011 Ashby
7,985,166 B2 7/2011 Farnsworth et al.
7,988,600 B2 8/2011 Rodgers, Jr.
7,992,879 B2 8/2011 Eisenberg et al.
8,001,472 B2 8/2011 Gilley et al.
8,002,674 B2 8/2011 Piaget et al.
8,002,684 B2 8/2011 Laurent
8,006,574 B2 8/2011 Meyer
8,007,407 B2 8/2011 Richter
8,007,409 B2 8/2011 Elllis
8,007,422 B2 8/2011 Zaccherini
8,009,045 B2 8/2011 Cehelnik
8,011,242 B2 9/2011 O'neill
8,012,003 B2 9/2011 Sterchi et al.
8,012,067 B2 9/2011 Joannou
8,012,068 B1 9/2011 Malcolm
8,021,277 B2 9/2011 Baudhuin
8,025,609 B2 9/2011 Giannelli et al.
8,029,415 B2 10/2011 Ashby et al.
8,029,418 B2 10/2011 Nishimura
8,033,959 B2 10/2011 Oleson et al.
8,037,574 B2 10/2011 Chase
8,038,117 B2 10/2011 Chen et al.
8,038,577 B2 10/2011 Mcintosh
8,040,117 B2 10/2011 Telefus
8,043,173 B2 10/2011 Menalagha et al.
8,047,965 B2 11/2011 Shea
8,047,966 B2 11/2011 Dorogusker et al.
8,047,970 B2 11/2011 Nalley
8,055,469 B2 11/2011 Kulach et al.
8,057,366 B2 11/2011 Schippers
8,057,368 B1 11/2011 Lyszczarz
8,062,196 B1 11/2011 Khubani
8,063,776 B2 11/2011 Ruha
8,065,926 B2 11/2011 Meyer
8,066,514 B2 11/2011 Clarke
8,070,657 B2 12/2011 Loach
8,079,937 B2 12/2011 Bedell
8,079,939 B1 12/2011 Wang
8,082,029 B2 12/2011 Honda
8,083,645 B2 12/2011 Asukai et al.
8,083,693 B1 12/2011 McKeon et al.
8,088,044 B2 1/2012 Tchao et al.
8,092,352 B2 1/2012 Irving et al.
8,096,925 B2 1/2012 Radding et al.
8,103,379 B2 1/2012 Biba et al.
8,103,517 B2 1/2012 Hinnebusch
8,104,411 B2 1/2012 Fenton
8,105,213 B2 1/2012 Stewart et al.
8,109,858 B2 2/2012 Redmann
8,109,864 B2 2/2012 Tseng
8,113,990 B2 2/2012 Kolman et al.
8,113,994 B2 2/2012 Piaget et al.
8,118,709 B2 2/2012 Mckirdy
8,118,888 B2 2/2012 Molter
8,123,527 B2 2/2012 Holljes
8,141,276 B2 3/2012 Ellis
8,147,385 B2 4/2012 Crawford et al.
8,152,702 B2 4/2012 Pacheco
8,162,769 B2 4/2012 Henry
8,162,804 B2 4/2012 Tagliabue
8,172,729 B2 5/2012 Ellis
8,177,688 B2 5/2012 Burnfield et al.
8,182,399 B2 5/2012 Davis et al.
8,188,700 B2 5/2012 Tseng et al.
8,192,332 B2 6/2012 Baker et al.
8,192,338 B2 6/2012 Solow
8,200,323 B2 6/2012 Dibenedetto et al.
8,206,266 B2 6/2012 Hall
8,221,290 B2 7/2012 Vincent et al.
8,221,295 B2 7/2012 Wilkins
8,235,724 B2 8/2012 Gilley et al.
8,240,430 B2 8/2012 Downey
8,241,182 B2 8/2012 Julskjaer et al.
8,241,186 B2 8/2012 Brodess et al.
8,241,187 B2 8/2012 Moon et al.
8,251,874 B2 8/2012 Ashby et al.
8,260,858 B2 9/2012 Belz et al.
8,272,996 B2 9/2012 Weier
8,275,265 B2 9/2012 Kobyakov et al.
8,280,259 B2 10/2012 George et al.
8,287,434 B2 10/2012 Zavadsky et al.
8,302,213 B2 11/2012 Kriesel
8,306,635 B2 11/2012 Pryor
8,309,870 B2 11/2012 Peterson et al.
8,310,468 B2 11/2012 Martin
8,315,823 B2 11/2012 Berme et al.
8,317,663 B2 11/2012 Stewart et al.
8,320,578 B2 11/2012 Kahn et al.
8,323,156 B2 12/2012 Ozawa et al.
8,323,157 B2 12/2012 Campanaro et al.
8,329,265 B2 12/2012 Cook
8,333,681 B2 12/2012 Schmidt
8,343,016 B1 1/2013 Astilean
8,360,904 B2 1/2013 Oleson et al.
8,360,935 B2 1/2013 Olsen et al.
8,360,936 B2 1/2013 Dibenedetto et al.
8,368,329 B1 2/2013 Depew et al.

(56) References Cited

U.S. PATENT DOCUMENTS 8,376,911 B2 2/2013 Ogg et al.
8,378,647 B2 2/2013 Yonezawa et al.
8,394,005 B2 3/2013 Solow et al.
8,395,366 B2 3/2013 Uno
8,398,529 B2 3/2013 Ellis
8,403,816 B2 3/2013 Park
8,429,223 B2 4/2013 Gilley et al.
8,435,160 B1 5/2013 Clum
8,446,275 B2 5/2013 Utter, II
8,449,620 B2 5/2013 Hakansson et al.
8,454,437 B2 6/2013 Dugan
8,459,479 B2 6/2013 Yourist
8,467,979 B2 6/2013 Sobolewski
8,475,346 B2 7/2013 Gerschefske et al.
8,475,367 B1 7/2013 Yuen et al.
8,480,541 B1 7/2013 Brunts
8,485,944 B2 7/2013 Drazan
8,485,945 B2 7/2013 Leonhard
8,493,757 B2 7/2013 Carletti et al.
8,505,597 B2 8/2013 Sharperson
8,506,370 B2 8/2013 Homsi
8,506,459 B2 8/2013 Cassidy et al.
8,512,209 B2 8/2013 Guidi et al.
8,512,210 B2 8/2013 Shauli
8,516,723 B2 8/2013 Ferrigan et al.
8,527,101 B2 9/2013 Burris et al.
8,533,620 B2 9/2013 Hoffman et al.
8,535,247 B2 9/2013 Williams
8,537,017 B2 9/2013 Mack et al.
8,540,560 B2 9/2013 Crowley et al.
8,540,607 B2 9/2013 Kissel et al.
8,550,962 B2 10/2013 Piaget et al.
8,552,859 B2 10/2013 Pakula et al.
8,556,090 B2 10/2013 Chen
8,562,489 B2 10/2013 Burton et al.
8,564,235 B2 10/2013 Burris et al.
8,569,963 B2 10/2013 Walters
8,571,250 B2 10/2013 Royer
8,573,982 B1 11/2013 Chuang
8,574,131 B2 11/2013 Daly
8,585,561 B2 11/2013 Watt et al.
8,602,951 B2 12/2013 Morris
8,608,624 B2 12/2013 Shabodyash et al.
8,614,595 B2 12/2013 Acatrinei
8,614,902 B2 12/2013 Pansier et al.
8,615,377 B1 12/2013 Yuen et al.
8,622,747 B2 1/2014 Chu et al.
8,647,240 B2 2/2014 Heidecke
8,651,030 B2 2/2014 Coffman
8,655,004 B2 2/2014 Prest et al.
8,657,724 B2 2/2014 Yang
8,671,853 B2 3/2014 Flaherty
8,678,897 B2 3/2014 Englert et al.
8,690,578 B1 4/2014 Nusbaum et al.
8,690,735 B2 4/2014 Watterson et al.
8,690,738 B1 4/2014 Astilian
8,701,567 B1 4/2014 Esfandiari et al.
8,702,430 B2 4/2014 Dibenedetto et al.
8,702,567 B2 4/2014 Hu
8,706,530 B2 4/2014 Ohnemus et al.
8,708,870 B2 4/2014 Nalley
8,714,346 B2 5/2014 Freitag
8,727,946 B2 5/2014 Greenhill et al.
8,727,947 B2 5/2014 Tagliabue
8,734,157 B1 5/2014 Hummel, III
8,734,301 B2 5/2014 Remelius
8,734,302 B2 5/2014 Hsieh
8,738,321 B2 5/2014 Yuen et al.
8,739,974 B2 6/2014 TeVault et al.
8,740,756 B2 6/2014 Shabodyash et al.
8,749,380 B2 6/2014 Vock et al.
8,758,201 B2 6/2014 Ashby et al.
8,762,077 B2 6/2014 Redmond
8,762,101 B2 6/2014 Yuen et al.
8,764,609 B1 7/2014 Elahmadie
8,777,820 B2 7/2014 Lo
8,783,326 B1 7/2014 Vaninger et al.
8,784,274 B1 7/2014 Chuang
8,786,575 B2 7/2014 Miller
8,790,222 B2 7/2014 Burger
8,801,578 B2 8/2014 Corbalis et al.
8,801,581 B2 8/2014 Lai et al.
8,801,582 B2 8/2014 Huang et al.
8,821,350 B2 9/2014 Maertz
8,823,314 B2 9/2014 Lumsden et al.
8,824,166 B2 9/2014 Rohrbach
8,824,697 B2 9/2014 Christoph
8,825,445 B2 9/2014 Hoffman et al.
8,837,174 B2 9/2014 Hosotani
8,839,725 B2 9/2014 Kooistra
8,840,569 B2 9/2014 Flaction et al.
8,845,498 B2 9/2014 Webb
8,851,565 B2 10/2014 Hontz et al.
8,858,409 B2 10/2014 Trees
8,864,627 B2 10/2014 Bayerlein et al.
8,876,661 B2 11/2014 Lu
8,876,668 B2 11/2014 Hendrickson et al.
8,888,660 B1 11/2014 Oteman
8,892,999 B2 11/2014 Nims et al.
8,894,549 B2 11/2014 Colledge
8,894,551 B2 11/2014 Kerdjoudj
8,913,409 B2 12/2014 Hui et al.
8,920,291 B2 12/2014 Chen et al.
8,922,498 B2 12/2014 Vesely
8,926,475 B2 1/2015 Lin et al.
8,926,479 B2 1/2015 Chen et al.
8,939,831 B2 1/2015 Dugan
8,956,290 B2 2/2015 Gilley et al.
8,956,715 B2 2/2015 Kim
8,961,439 B2 2/2015 Yang et al.
8,968,163 B1 3/2015 Vidmar
8,979,709 B2 3/2015 Toback et al.
8,986,165 B2 3/2015 Ashby
8,986,807 B2 3/2015 Rodgers
8,986,808 B2 3/2015 George
8,990,732 B2 3/2015 Farrenkopf et al.
8,996,978 B2 3/2015 Richstein et al.
9,005,085 B2 4/2015 Astilean
9,008,973 B2 4/2015 French
9,011,291 B2 4/2015 Birrell
9,015,952 B2 4/2015 Magosaki
9,028,368 B2 * 5/2015 Ashby ..... G06F 19/3481 482/1
9,033,137 B2 5/2015 Koppes et al.
9,033,712 B2 5/2015 Vasin
9,038,218 B1 5/2015 Heil et al.
9,039,578 B2 5/2015 Dalebout
9,044,637 B2 6/2015 Karl
9,050,486 B2 6/2015 Reed
9,050,491 B2 6/2015 Gordon et al.
9,050,498 B2 6/2015 Lu et al.
9,063,026 B2 6/2015 Nassef
9,072,932 B2 7/2015 Piaget et al.
9,072,941 B2 7/2015 Duda et al.
9,081,534 B2 7/2015 Yuen et al.
9,081,889 B2 7/2015 Ingrassia et al.
9,083,245 B2 7/2015 Zhao et al.
9,084,565 B2 7/2015 Mason et al.
9,084,712 B2 7/2015 Roerdink et al.
9,089,732 B2 7/2015 Andon et al.
9,091,008 B2 7/2015 Mathieu
9,095,740 B2 8/2015 Wu
9,108,079 B2 8/2015 Solow et al.
9,108,081 B2 8/2015 Giannelli et al.
9,114,275 B2 8/2015 Lu et al.
9,114,276 B2 8/2015 Bayerlein et al.
9,119,983 B2 9/2015 Rhea
9,132,051 B2 9/2015 Heil
9,138,614 B2 9/2015 Lu et al.
9,138,615 B2 9/2015 Olson et al.
9,144,703 B2 9/2015 Dalebout et al.
9,148,077 B2 9/2015 Henderson
9,162,102 B1 10/2015 Eder et al.
9,162,106 B1 10/2015 Scheiman

(56) References Cited

U.S. PATENT DOCUMENTS 9,168,414 B2 10/2015 Liu et al.
9,174,085 B2 11/2015 Foley
9,186,537 B2 11/2015 Arnold et al.
9,186,549 B2 11/2015 Watterson et al.
9,186,552 B1 11/2015 Deal
9,192,800 B1 11/2015 Meyer et al.
9,198,622 B2 12/2015 Kaleal et al.
9,199,115 B2 12/2015 Yim et al.
9,199,123 B2 12/2015 Solow
9,201,458 B2 12/2015 Hunt et al.
9,220,940 B2 12/2015 Al Kuwari
9,221,545 B2 12/2015 Popescu et al.
9,223,936 B2 12/2015 Aragones et al.
9,224,291 B2 12/2015 Moll-Carrillo et al.
9,226,692 B2 1/2016 Haas
9,242,139 B2 1/2016 Holley
9,242,142 B2 1/2016 Vincent et al.
9,256,711 B2 2/2016 Horseman
9,257,054 B2 2/2016 Coza et al.
9,263,967 B2 2/2016 McCune
9,283,431 B2 3/2016 Marty
9,289,063 B2 3/2016 Baugh et al.
9,289,674 B2 3/2016 Winsper et al.
9,308,415 B2 4/2016 Crawford et al.
9,311,802 B1 4/2016 Chin et al.
9,314,666 B2 4/2016 Canavan et al.
9,317,660 B2 4/2016 Burich et al.
9,320,457 B2 4/2016 Flaction et al.
9,330,239 B2 5/2016 Koduri et al.
9,330,544 B2 5/2016 Levesque et al.
9,333,388 B2 5/2016 Lee et al.
9,339,681 B1 5/2016 Nalley
9,339,683 B2 5/2016 Dilli et al.
9,352,185 B2 5/2016 Hendrickson et al.
9,352,186 B2 5/2016 Watterson
9,352,187 B2 5/2016 Piaget et al.
9,357,551 B2 5/2016 Gutman
9,358,422 B2 6/2016 Brontman
9,364,706 B2 6/2016 Lo
9,364,708 B2 6/2016 Luger et al.
9,364,714 B2 6/2016 Koduri et al.
9,367,668 B2 * 6/2016 Flynt ..... G06F 19/3481
9,369,178 B2 6/2016 Matsutani
9,370,687 B2 6/2016 Hao
9,370,691 B2 6/2016 Nissila et al.
9,378,336 B2 6/2016 Ohnemus et al.
9,387,387 B2 7/2016 Dalebout
9,389,718 B1 7/2016 Letourneur
9,392,941 B2 7/2016 Powch et al.
9,409,050 B2 8/2016 Mintz
9,411,940 B2 8/2016 Burroughs et al.
9,415,257 B2 8/2016 Habing
9,427,615 B2 8/2016 Pretz et al.
9,452,315 B1 9/2016 Murray et al.
9,452,320 B2 9/2016 Yang
9,455,623 B2 9/2016 Fan et al.
9,455,784 B2 9/2016 Cune et al.
9,457,224 B2 10/2016 Giannelli et al.
9,457,256 B2 10/2016 Aragones et al.
9,463,349 B1 10/2016 Chang
9,480,874 B2 11/2016 Cutler
9,486,658 B2 11/2016 Alexander
9,498,671 B1 11/2016 Softky
9,505,241 B2 11/2016 Lyon
9,511,254 B2 12/2016 Netter
9,511,259 B2 12/2016 Mountain
9,511,864 B2 12/2016 Simpson
9,521,901 B2 12/2016 Dalebout
9,539,458 B1 1/2017 Ross
9,540,071 B2 1/2017 Jordan et al.
9,540,174 B2 1/2017 Josserond et al.
9,545,541 B2 1/2017 Aragones et al.
9,560,917 B2 2/2017 Roslund, Jr.
9,569,986 B2 2/2017 Levine et al.
9,573,017 B2 2/2017 Chang
9,579,534 B2 2/2017 Sutkowski et al.
9,579,544 B2 2/2017 Watterson
9,582,976 B2 2/2017 Chin et al.
9,586,085 B2 3/2017 Arnold et al.
9,586,090 B2 3/2017 Watterson et al.
9,604,099 B2 3/2017 Taylor
9,604,757 B2 3/2017 Spivack et al.
9,610,475 B1 4/2017 DeKnock et al.
9,610,506 B2 4/2017 Dugan
9,623,286 B1 4/2017 Chen
9,642,415 B2 5/2017 Pease et al.
9,665,873 B2 5/2017 Ackland
9,673,904 B2 6/2017 Palanisamy et al.
9,681,313 B2 6/2017 Malach
9,682,306 B2 6/2017 Lin et al.
9,682,307 B2 6/2017 Dalebout
9,694,234 B2 7/2017 Dalebout et al.
9,700,780 B2 7/2017 Riley et al.
9,707,441 B2 7/2017 Yang
9,707,447 B1 7/2017 Lopez Babodilla
9,731,158 B1 8/2017 Lo
9,737,747 B1 8/2017 Walsh et al.
9,737,755 B2 8/2017 Dalebout
9,757,605 B2 9/2017 Olson et al.
9,764,184 B2 9/2017 Kueker et al.
9,776,039 B1 10/2017 Xu
9,782,625 B1 10/2017 Blum et al.
9,795,827 B2 10/2017 Wiener et al.
9,808,672 B2 * 11/2017 Dalebout ..... A63B 22/0242
9,808,673 B2 11/2017 Robinson
9,814,927 B2 11/2017 Forystek
9,814,929 B2 11/2017 Moser
9,814,930 B2 11/2017 Manzke et al.
9,827,458 B2 11/2017 Dalton
9,829,068 B2 11/2017 Marchetti
9,833,658 B2 12/2017 Wiener et al.
9,846,438 B2 12/2017 Rihn et al.
9,849,330 B2 12/2017 Lagree
9,884,222 B2 2/2018 Chen
9,889,334 B2 * 2/2018 Ashby ..... A63B 22/0235
9,895,567 B2 2/2018 Lee
9,901,767 B2 2/2018 Kuo
9,901,780 B2 2/2018 DeLuca et al.
9,901,805 B2 2/2018 Hughes, Jr.
9,914,011 B2 3/2018 Downey et al.
9,914,014 B2 3/2018 Lagree
9,937,375 B2 4/2018 Zhu
9,943,719 B2 4/2018 Smith et al.
9,948,349 B2 4/2018 Malach
9,950,209 B2 4/2018 Yim et al.
9,956,450 B2 5/2018 Bayerlein et al.
9,968,821 B2 5/2018 Finlayson et al.
9,968,823 B2 5/2018 Cutler
9,975,003 B2 5/2018 Molins et al.
9,979,182 B2 5/2018 Lin et al.
9,987,513 B2 6/2018 Yim et al.
9,987,517 B1 6/2018 Kuo
9,990,126 B2 6/2018 Chanyontpatanakul
9,993,680 B2 6/2018 Gordon
9,993,711 B2 6/2018 Moya Saez
10,004,940 B2 6/2018 Badarneh
10,004,945 B2 6/2018 Sauter
10,010,169 B2 7/2018 Grotenhuis
10,022,590 B2 7/2018 Foley et al.
10,036,443 B2 7/2018 Galasso et al.
10,039,952 B2 8/2018 Chang
10,039,970 B2 8/2018 Lee et al.
10,046,222 B2 8/2018 Hawkins, III et al.
10,065,070 B2 9/2018 Huang
10,070,816 B2 9/2018 Cowley et al.
10,086,254 B2 10/2018 Watterson
2001/0001303 A1 5/2001 Ohsuga et al.
2001/0008053 A1 7/2001 Belli
2002/0016235 A1 2/2002 Ashby et al.
2002/0025888 A1 2/2002 Germanton
2002/0043909 A1 4/2002 Nielsen
2002/0055418 A1 5/2002 Pyles et al.
2002/0055422 A1 5/2002 Airmet
2002/0066735 A1 6/2002 Hewlitt et al.

(56) References Cited

U.S. PATENT DOCUMENTS

2002/0077221 A1 6/2002 Dalebout et al.
2002/0128127 A1 9/2002 Chen
2002/0160883 A1 10/2002 Dugan
2003/0045406 A1 3/2003 Stone
2003/0060344 A1 3/2003 David
2003/0069108 A1 4/2003 Rubinstein et al.
2003/0073545 A1 4/2003 Liu
2003/0092532 A1 5/2003 Giannelli et al.
2003/0092540 A1 5/2003 Gillen
2003/0096675 A1 5/2003 Wang
2003/0104908 A1 6/2003 Tung
2003/0128186 A1 7/2003 Laker
2003/0134718 A1 7/2003 Kim
2003/0148853 A1 8/2003 Alessandri
2003/0171189 A1 9/2003 Kaufman
2003/0171190 A1 9/2003 Rice
2003/0176815 A1 9/2003 Baba et al.
2003/0211916 A1 11/2003 Capuano
2004/0005961 A1 1/2004 Iund
2004/0014571 A1 1/2004 Haynes
2004/0023761 A1 2/2004 Emery
2004/0023766 A1 2/2004 Slone
2004/0025754 A1 2/2004 Dye
2004/0029645 A1 2/2004 Chen
2004/0043873 A1 3/2004 Wilkinson et al.
2004/0051392 A1 3/2004 Badarneh
2004/0053748 A1 3/2004 Lo et al.
2004/0100484 A1 5/2004 Barrett
2004/0132586 A1 7/2004 Leighton et al.
2004/0138030 A1 7/2004 Wang
2004/0152566 A1 8/2004 Yeh
2004/0160336 A1 8/2004 Hoch
2004/0163574 A1 8/2004 Schoenbach
2004/0171464 A1 9/2004 Ashby et al.
2004/0171465 A1 9/2004 Hald
2004/0176215 A1 9/2004 Gramaccioni
2004/0180719 A1 9/2004 Feldman
2004/0181972 A1 9/2004 Csorba
2004/0224740 A1 11/2004 Ball et al.
2004/0242378 A1 12/2004 Pan
2004/0242380 A1 12/2004 Kuivala
2004/0266587 A1 12/2004 Miller
2005/0003931 A1 1/2005 Mills et al.
2005/0008992 A1 1/2005 Westergaard et al.
2005/0009668 A1 1/2005 Savettiere
2005/0023292 A1 2/2005 Market et al.
2005/0037904 A1 2/2005 Chang
2005/0043155 A1 2/2005 Yannitte
2005/0049117 A1 3/2005 Rodgers
2005/0054492 A1 3/2005 Neff
2005/0075213 A1 4/2005 Arick
2005/0096189 A1 5/2005 Chen
2005/0107220 A1 5/2005 Wang
2005/0107226 A1 5/2005 Monda
2005/0143226 A1 6/2005 Heidecke
2005/0148440 A1 7/2005 Denton
2005/0148442 A1 7/2005 Watterson
2005/0159273 A1 7/2005 Chen
2005/0164839 A1 7/2005 Watterson
2005/0170935 A1 8/2005 Manser
2005/0170936 A1 8/2005 Quinn
2005/0172311 A1 8/2005 Hjelt et al.
2005/0181347 A1 8/2005 Barnes et al.
2005/0196737 A1 9/2005 Mann
2005/0209050 A1 9/2005 Bartels
2005/0239600 A1 10/2005 Liang
2005/0239607 A1 10/2005 Chang
2005/0245370 A1 11/2005 Boland
2005/0272562 A1 12/2005 Alessandri et al.
2005/0272577 A1 12/2005 Olson
2005/0277520 A1 12/2005 Van Waes
2005/0288155 A1 12/2005 Yang
2006/0003869 A1 1/2006 Huang et al.
2006/0019804 A1 1/2006 Young
2006/0035757 A1 2/2006 Flick et al.
2006/0040797 A1 2/2006 Chang
2006/0047447 A1 3/2006 Brady et al.
2006/0058162 A1 3/2006 Vieno et al.
2006/0063644 A1 3/2006 Yang
2006/0122038 A1 6/2006 Chou Lin
2006/0122044 A1 6/2006 Ho
2006/0135322 A1 6/2006 Rocker
2006/0148622 A1 7/2006 Chen
2006/0160665 A1 7/2006 Tai
2006/0160666 A1 7/2006 Wang
2006/0166791 A1 7/2006 Liao
2006/0166799 A1 7/2006 Boland et al.
2006/0172862 A1 8/2006 Badarneh et al.
2006/0189440 A1 8/2006 Gravagne
2006/0194679 A1 8/2006 Hatcher
2006/0205568 A1 9/2006 Huang
2006/0240947 A1 10/2006 Qu
2006/0240951 A1 10/2006 Wang
2006/0240959 A1 10/2006 Huang
2006/0244187 A1 11/2006 Downey
2006/0247109 A1 11/2006 Powell
2006/0248965 A1 11/2006 Wyatt
2006/0252602 A1 11/2006 Brown
2006/0258513 A1 11/2006 Routley
2006/0276306 A1 12/2006 Pan et al.
2006/0287089 A1 12/2006 Addington et al.
2006/0287147 A1 12/2006 Kriesel
2006/0287163 A1 12/2006 Wang
2006/0288846 A1 12/2006 Logan
2007/0004562 A1 1/2007 Pan et al.
2007/0004569 A1 1/2007 Cao
2007/0006489 A1 1/2007 Case, Jr. et al.
2007/0027002 A1 2/2007 Clark et al.
2007/0038137 A1 2/2007 Arand et al.
2007/0042868 A1 2/2007 Fisher
2007/0049464 A1 3/2007 Chou
2007/0049465 A1 3/2007 Wu
2007/0049466 A1 3/2007 Hubbard
2007/0049470 A1 3/2007 Pyles et al.
2007/0060449 A1 3/2007 Lo
2007/0060451 A1 3/2007 Lucas
2007/0066448 A1 3/2007 Pan et al.
2007/0087908 A1 4/2007 Pan et al.
2007/0111858 A1 5/2007 Dugan
2007/0117683 A1 5/2007 Ercanbrack et al.
2007/0123389 A1 5/2007 Martin
2007/0123390 A1 5/2007 Mathis
2007/0123396 A1 5/2007 Ellis
2007/0135264 A1 6/2007 Rosenberg
2007/0142177 A1 6/2007 Simms et al.
2007/0142183 A1 6/2007 Chang
2007/0151489 A1 7/2007 Byrne
2007/0155277 A1 7/2007 Amitai et al.
2007/0155495 A1 7/2007 Goo
2007/0161468 A1 7/2007 Yanagisawa et al.
2007/0167292 A1 7/2007 Kuo
2007/0190508 A1 8/2007 Dalton
2007/0191190 A1 8/2007 Kuo
2007/0197353 A1 8/2007 Hundley
2007/0201727 A1 8/2007 Birrell et al.
2007/0204430 A1 9/2007 Chase
2007/0214630 A1 9/2007 Kim
2007/0219066 A1 9/2007 Wang
2007/0225119 A1 9/2007 Schenk
2007/0225126 A1 9/2007 Yoo
2007/0225127 A1 9/2007 Pan et al.
2007/0232455 A1 10/2007 Hanoun
2007/0232463 A1 10/2007 Wu
2007/0245612 A1 10/2007 Tresenfeld
2007/0247320 A1 10/2007 Morahan
2007/0270667 A1 11/2007 Coppi et al.
2007/0270726 A1 11/2007 Chou
2007/0281828 A1 12/2007 Rice
2007/0281831 A1 12/2007 Wang
2007/0284495 A1 12/2007 Charles
2007/0296313 A1 12/2007 Wang
2007/0298935 A1 12/2007 Badarneh
2007/0298937 A1 12/2007 Shah
2008/0001772 A1 1/2008 Saito

(56) References Cited

U.S. PATENT DOCUMENTS

2008/0004162 A1 1/2008 Chen
2008/0018211 A1 1/2008 Dye
2008/0020898 A1 1/2008 Pyles et al.
2008/0020907 A1 1/2008 Lin
2008/0026658 A1 1/2008 Kriesel
2008/0026838 A1 1/2008 Dunstan et al.
2008/0032864 A1 2/2008 Hakki
2008/0032870 A1 2/2008 Wu
2008/0039301 A1 2/2008 Halbridge
2008/0046246 A1 2/2008 Hakki
2008/0057889 A1 3/2008 Jan
2008/0070756 A1 3/2008 Chu
2008/0076972 A1 3/2008 Dorogusker et al.
2008/0096745 A1 4/2008 Perry
2008/0103024 A1 5/2008 Habing
2008/0103034 A1 5/2008 Mihara et al.
2008/0108917 A1 5/2008 Joutras et al.
2008/0139370 A1 6/2008 Charnitski
2008/0153682 A1 6/2008 Chen et al.
2008/0155077 A1 6/2008 James
2008/0161170 A1 7/2008 Lumpee
2008/0161653 A1 7/2008 Lin et al.
2008/0171640 A1 7/2008 Chang
2008/0171922 A1 7/2008 Teller
2008/0176717 A1 7/2008 Wang
2008/0176718 A1 7/2008 Wang
2008/0182724 A1 7/2008 Guthrie
2008/0187689 A1 8/2008 Dierkens et al.
2008/0188362 A1 8/2008 Chen
2008/0191864 A1 8/2008 Wolfson
2008/0200287 A1 8/2008 Marty et al.
2008/0207407 A1 8/2008 Yeh
2008/0214971 A1 9/2008 Talish
2008/0216717 A1 9/2008 Jones
2008/0228110 A1 9/2008 Berme
2008/0229875 A1 9/2008 Ray
2008/0234111 A1 9/2008 Packham
2008/0242511 A1 10/2008 Munoz et al.
2008/0250729 A1 10/2008 Kriesel
2008/0255794 A1 10/2008 Levine
2008/0279896 A1 11/2008 Heinen et al.
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0300110 A1 12/2008 Smith et al.
2008/0300115 A1 12/2008 Erlandson
2008/0300914 A1 12/2008 Karkanias et al.
2008/0312047 A1 12/2008 Feng
2008/0318737 A1 12/2008 Chu
2009/0001831 A1 1/2009 Cho et al.
2009/0023553 A1 1/2009 Shim
2009/0027925 A1 1/2009 Kanouda et al.
2009/0029831 A1 1/2009 Weier
2009/0042698 A1 2/2009 Wang
2009/0048073 A1 2/2009 Roimicher
2009/0048493 A1 2/2009 James et al.
2009/0054751 A1 2/2009 Babashan et al.
2009/0069159 A1 3/2009 Wang
2009/0075781 A1 3/2009 Schwarzberg et al.
2009/0075784 A1 3/2009 Hoggan
2009/0080808 A1 3/2009 Hagen
2009/0093347 A1 4/2009 Wang
2009/0105052 A1 4/2009 Dalebout et al.
2009/0105548 A1 4/2009 Bart
2009/0111664 A1 4/2009 Kau
2009/0111666 A1 4/2009 Wang
2009/0111670 A1 4/2009 Williams
2009/0118098 A1 5/2009 Yeh
2009/0124463 A1 5/2009 Lin
2009/0124464 A1 5/2009 Kastelic
2009/0124465 A1 5/2009 Wang
2009/0124466 A1 5/2009 Hunter
2009/0128516 A1 5/2009 Rimon et al.
2009/0156363 A1 6/2009 Guidi et al.
2009/0156364 A1 6/2009 Simeoni
2009/0158871 A1 6/2009 Chuo
2009/0163327 A1 6/2009 Huang et al.
2009/0170672 A1 7/2009 Mcmullen
2009/0180646 A1 7/2009 Vulfson et al.
2009/0181829 A1 7/2009 Wu
2009/0181830 A1 7/2009 Wu
2009/0181831 A1 7/2009 Kuo
2009/0209393 A1 8/2009 Crater et al.
2009/0221405 A1 9/2009 Wang
2009/0221407 A1 9/2009 Hauk
2009/0258710 A1 10/2009 Quatrochi et al.
2009/0269728 A1 10/2009 Verstegen et al.
2009/0286653 A1 11/2009 Wiber
2010/0015585 A1 1/2010 Baker
2010/0022354 A1 1/2010 Fisher
2010/0034665 A1 2/2010 Zhong et al.
2010/0035726 A1 2/2010 Fisher et al.
2010/0063426 A1 3/2010 Planke
2010/0064255 A1 3/2010 Rottler et al.
2010/0079291 A1 4/2010 Kroll et al.
2010/0081548 A1 4/2010 Labedz
2010/0105527 A1 4/2010 Johnson
2010/0113223 A1 5/2010 Chiles et al.
2010/0130337 A1 5/2010 Stewart
2010/0137105 A1 6/2010 McLaughlin
2010/0175634 A1 7/2010 Chang et al.
2010/0192715 A1 8/2010 Aircelle
2010/0197462 A1 8/2010 Piane, Jr.
2010/0197465 A1 8/2010 Stevenson
2010/0210418 A1 8/2010 Park
2010/0216600 A1 8/2010 Noffsinger
2010/0216607 A1 8/2010 Mueller
2010/0227740 A1 9/2010 Liu
2010/0240458 A1 9/2010 Gaiba et al.
2010/0279822 A1 11/2010 Ford
2010/0285933 A1 11/2010 Nalley
2010/0304931 A1 12/2010 Stumpf
2010/0311552 A1 12/2010 Sumners
2011/0028282 A1 2/2011 Sbragia
2011/0054359 A1 3/2011 Sazonov et al.
2011/0056328 A1 3/2011 Ko
2011/0061840 A1 3/2011 Goldmann
2011/0065371 A1 3/2011 Leff
2011/0065373 A1 3/2011 Goldmann
2011/0067361 A1 3/2011 Sloan
2011/0073743 A1 3/2011 Shamie
2011/0082013 A1 4/2011 Bastian
2011/0086707 A1 4/2011 Loveland
2011/0087137 A1 4/2011 Hanoun
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0131005 A1 6/2011 Ueshima et al.
2011/0136627 A1 6/2011 Williams
2011/0143769 A1 6/2011 Jones et al.
2011/0152037 A1 6/2011 Tsou
2011/0152635 A1 6/2011 Morris et al.
2011/0165995 A1 7/2011 Paulus
2011/0172060 A1 7/2011 Morales et al.
2011/0175744 A1 7/2011 Englert et al.
2011/0201481 A1 8/2011 Lo
2011/0205164 A1 8/2011 Hansen et al.
2011/0221672 A1 9/2011 Osterhout et al.
2011/0275489 A1 11/2011 Apau
2011/0275499 A1 11/2011 Eschenbach
2011/0281691 A1 11/2011 Ellis
2011/0308919 A1 12/2011 Hahn
2012/0010053 A1 1/2012 Bayerlein et al.
2012/0021873 A1 1/2012 Brunner
2012/0071301 A1 3/2012 Kaylor et al.
2012/0088633 A1 4/2012 Crafton
2012/0088640 A1 4/2012 Wissink
2012/0132877 A1 5/2012 Wang
2012/0165162 A1 6/2012 Lu
2012/0174833 A1 7/2012 Early
2012/0178590 A1 7/2012 Lu
2012/0190502 A1 7/2012 Paulus et al.

(56) References Cited

U.S. PATENT DOCUMENTS

2012/0218184 A1 8/2012 Wissmar
2012/0220427 A1 8/2012 Ashby et al.
2012/0230504 A1 9/2012 Kuroda
2012/0242774 A1 9/2012 Numano et al.
2012/0253489 A1 10/2012 Dugan
2012/0258433 A1 10/2012 Hope et al.
2012/0270705 A1 10/2012 Lo
2012/0293141 A1 11/2012 Zhang et al.
2012/0298017 A1 11/2012 Chen
2012/0326873 A1 12/2012 Utter, II
2013/0002533 A1 1/2013 Burroughs et al.
2013/0018494 A1 1/2013 Amini
2013/0053222 A1 2/2013 Lo
2013/0130868 A1 5/2013 Hou
2013/0130869 A1 5/2013 Hou
2013/0141235 A1 6/2013 Utter, II
2013/0147411 A1 6/2013 Pang et al.
2013/0150214 A1 6/2013 Wu
2013/0154441 A1 6/2013 Redmond
2013/0172152 A1 7/2013 Watterson
2013/0185003 A1 7/2013 Carbeck et al.
2013/0190136 A1 7/2013 Watterson
2013/0196821 A1 8/2013 Watterson et al.
2013/0196827 A1 8/2013 Chang
2013/0228063 A1 9/2013 Turner
2013/0237383 A1 9/2013 Chen
2013/0245966 A1 9/2013 Burroughs et al.
2013/0263418 A1 10/2013 Johnson, Jr.
2013/0267385 A1 10/2013 Watterson et al.
2013/0267386 A1 10/2013 Her
2013/0274071 A1 10/2013 Wang
2013/0346043 A1 12/2013 Mewes et al.
2014/0011645 A1 1/2014 Johnson et al.
2014/0026788 A1 1/2014 Kallio, III et al.
2014/0031703 A1 1/2014 Rayner et al.
2014/0056461 A1 2/2014 Afshar
2014/0073488 A1 3/2014 Wu
2014/0080678 A1 3/2014 Wu
2014/0085077 A1 3/2014 Luna et al.
2014/0121066 A1 5/2014 Huang et al.
2014/0156228 A1 6/2014 Molettiere et al.
2014/0187383 A1 7/2014 Martin
2014/0221160 A1 8/2014 Hardy et al.
2014/0221167 A1 8/2014 Wu
2014/0222173 A1 8/2014 Giedwoyn et al.
2014/0274564 A1 9/2014 Greenbaum
2014/0274579 A1 9/2014 Olson
2014/0358473 A1 12/2014 Goel et al.
2014/0360413 A1 12/2014 Schenk
2015/0003621 A1 1/2015 Trammell
2015/0004579 A1 1/2015 Shelton
2015/0016623 A1 1/2015 Trammell
2015/0044648 A1 2/2015 White et al.
2015/0065273 A1 3/2015 Lake
2015/0065301 A1 3/2015 Oteman
2015/0105220 A1 4/2015 Hong
2015/0201722 A1 7/2015 Brouard
2015/0202487 A1 7/2015 Wu
2015/0209610 A1 7/2015 Dalebout et al.
2015/0209617 A1 7/2015 Hsiao
2015/0251047 A1 9/2015 Maaniitty
2015/0251055 A1 9/2015 Ashby
2015/0253210 A1 9/2015 Ashby et al.
2015/0265903 A1 9/2015 Kolen et al.
2015/0352396 A1 12/2015 Dalebout
2015/0352401 A1 12/2015 Johnson
2015/0367176 A1 12/2015 Bejestan et al.
2016/0008650 A1 1/2016 Jue et al.
2016/0016035 A1 1/2016 Hao
2016/0027325 A1 1/2016 Malhotra
2016/0047446 A1 2/2016 Hung
2016/0096064 A1 4/2016 Gatti
2016/0175643 A1 6/2016 Kueker et al.
2016/0193518 A1 7/2016 Baxter
2016/0211841 A1 7/2016 Harrison
2016/0219968 A1 8/2016 Martin
2016/0263426 A1 9/2016 Mueller et al.
2016/0303421 A1 10/2016 Tyger et al.
2016/0367851 A1 12/2016 Astilean et al.
2017/0056726 A1 3/2017 Dalebout et al.
2017/0068782 A1 3/2017 Pillai et al.
2017/0113093 A1 4/2017 Bellavista et al.
2017/0136289 A1 5/2017 Frank
2017/0136291 A1 5/2017 Huang
2017/0136339 A1 5/2017 Habiche
2017/0165523 A1 6/2017 Chou
2017/0189745 A1 7/2017 Hamilton et al.
2017/0216660 A1 8/2017 Lernihan
2017/0266483 A1 9/2017 Dalebout et al.
2017/0266532 A1 9/2017 Watterson
2017/0266533 A1 9/2017 Dalebout
2017/0266534 A1 9/2017 Watterson
2017/0274242 A1 9/2017 Corbalis
2017/0326411 A1 11/2017 Watterson
2017/0368442 A1 12/2017 Baudhuin
2018/0001135 A1 1/2018 Powell
2018/0036585 A1 2/2018 Powell
2018/0056111 A1 3/2018 Chiang et al.
2018/0092603 A1 4/2018 Duan et al.
2018/0099179 A1 4/2018 Chatterton et al.
2018/0099180 A1 4/2018 Wilkinson
2018/0099181 A1 4/2018 Powell et al.
2018/0104533 A1 4/2018 Powell et al.
2018/0111018 A1 4/2018 Lee
2018/0117385 A1 5/2018 Watterson et al.
2018/0117388 A1 5/2018 Porter
2018/0117419 A1* 5/2018 Jackson ..... A63B 22/025
2018/0147440 A1 5/2018 Lin
2018/0154205 A1 6/2018 Watterson
2018/0154207 A1* 6/2018 Hochstrasser ..... A63B 22/0023
2018/0154208 A1 6/2018 Powell et al.

FOREIGN PATENT DOCUMENTS

EP 3233219 A1 10/2017
KR 10-1571361 B1 11/2015
KR 101571361 11/2015
TW 582287 4/2004
WO WO 2016-100530 A1 6/2016

OTHER PUBLICATIONS

International Search Report issued in PCT/US2017/054930 dated Jan. 16, 2018.
Machine English translation of Abstract of KR 101571361. Nov. 24, 2015.
U.S. Appl. No. 10/949,271, filed Sep. 26, 2006, Joseph Maresh et al.
Search Report issued in Taiwan Patent Application No. 106134446, dated May 9, 2018, 13 pages.
International Search Report issued in PCT/US2017/054930, dated Jan. 16, 2019, 3 pages.

* cited by examiner

CONSOLE POSITIONING

RELATED APPLICATIONS

This application claims priority to U.S. Patent Application Ser. No. 62/406,287 titled "Console Positioning" and filed on 10 Oct. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to perform an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes, to name a few.

One type of treadmill is disclosed in U.S. Patent Publication No. 2012/0220427 issued to Darren C. Ashby, et al. In this reference, an exercise system includes one or more exercise devices that communicate via a network with a communication system. The communication system stores and/or generates exercise programming for use on the exercise device. The exercise programming is able to control one or more operating parameters of the exercise device to simulate terrain found at a remote, real world location. The exercise programming can include images/videos of the remote, real world location. The control signals and the images/videos can be synchronized so that a user of the exercise device is able to experience, via the changing operating parameters, the topographical characteristics of the remote, real world location as well as see images of the location. Another type of treadmill is described in U.S. Patent Publication No. 2009/0209393 issued to Bradley A. Crater, et al. These references are incorporated by reference for all that they disclose.

SUMMARY

In one embodiment, a method for positioning a console of an exercise device includes determining an angle formed between an exercise deck of the exercise device and a base of the exercise device, and adjusting a physical height of a console of the exercise device to a correlated height, relative to the base, based at least in part on the angle of the exercise deck.

The correlated height may have a proportional relationship with a change in the angle.

The correlated height may be based in part on a user preference.

The user preference may be stored in a user profile.

The correlated height may be based in part on a location of a load applied to the deck by the user during the performance of an exercise.

The method may include determining the location with at least one optical sensor.

The method may include determining the location with at least one load cell sensor.

Determining the angle may include determining a height of at least of portion of the deck with a distance sensor.

The sensor may be incorporated into the console.

The method may include determining the correlated height.

Determining the correlated height may include multiplying a change in the angle by a proportionality constant to determine a proportional height.

Determining the correlated height may further include adjusting the correlated height from the proportional height based on user preferences.

Determining the correlated height further may include adjusting the correlated height from the proportional height based on a location of a load applied to the deck by the user during the performance of an exercise.

Determining the angle may automatically occur in response to activating an incline mechanism.

In one embodiment, a method for positioning a console of an exercise device includes determining an angle formed between an exercise deck of the exercise device and a base of the exercise device and adjusting a physical height of a console of the exercise device to a correlated height based at least in part on the angle of the exercise deck and a user preference.

Determining the correlated height may include multiplying a change in the angle by a proportionality constant to determine a proportional height Determining the correlated height may include adjusting the correlated height from the proportional height based on user preferences.

Determining the correlated height may include adjusting the correlated height from the proportional height based on a location of a load applied to the deck by the user during the performance of an exercise.

Determining the angle may occur automatically in response to activating an incline mechanism.

In one embodiment, a method for positioning a console of an exercise device includes determining an angle formed between an exercise deck of the exercise device and a base of the exercise device by multiplying a change in the angle by a proportionality constant to determine a proportional height, refining the correlated height from the proportional height based on user preferences and a location of a load applied to the deck by the user during the performance of an exercise, where the determining the angle occurs automatically in response to activating an incline mechanism, and adjusting a physical height of a console of the exercise device to a correlated height based at least in part on the angle of the exercise deck and a user preference.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
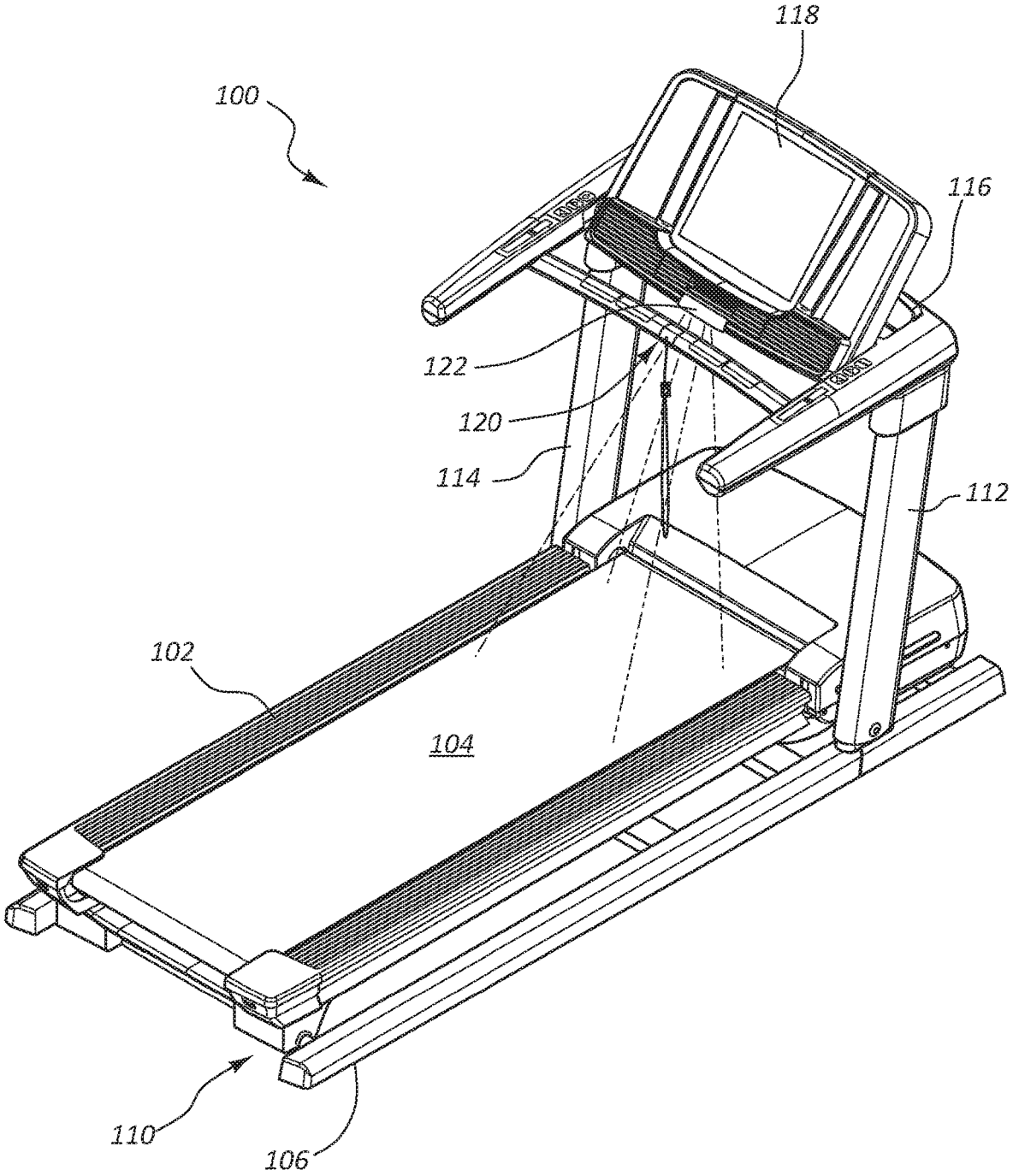
FIG. 1 illustrates a perspective view of an example of a treadmill in a neutral position in accordance with the present disclosure.

FIG. 1 depicts an example of a treadmill 100 having a deck 102 with a first pulley disposed in a front portion of the deck 102 and a second pulley incorporated into a rear portion of the deck 102. A tread belt 104 surrounds the first pulley and the second pulley. A motor is in mechanical communication with either the first pulley or the second pulley.

The rear portion of the deck 102 is attached to a base member 106 of the treadmill's frame. A pivot connection 110 between the rear portion of the deck 102 and the base member 106 allows the front portion of the deck 102 to incline upwards or decline downwards. When the deck 102 inclines or declines, the base member 106 remains stationary.

A first side post 112 is attached to a first side of the base member 106, and a second side post 114 is attached to a second side of the base member 106. In the example depicted in FIG. 1, the first side post 112 and the second side post 114 also remain stationary as the deck 102 inclines and/or declines. The first side post 112 and the second side post 114 collectively support a console 116. The console 116 includes a display 118 and an input mechanism 120 for controlling the deck's incline angle.

A sensor 122 is incorporated into the console 116. In some examples, the sensor 122 is a distance sensor that is oriented to determine the distance between the deck 102 and the console 116. As the deck 102 moves relative to the console 116, the sensor 122 can determine the movement changes. In response to the movement changes, the sensor 122 can send a message to actuators to cause the console to move so that the console 116 and the deck 102 can maintain a predetermined distance from one another.

Figure 2:
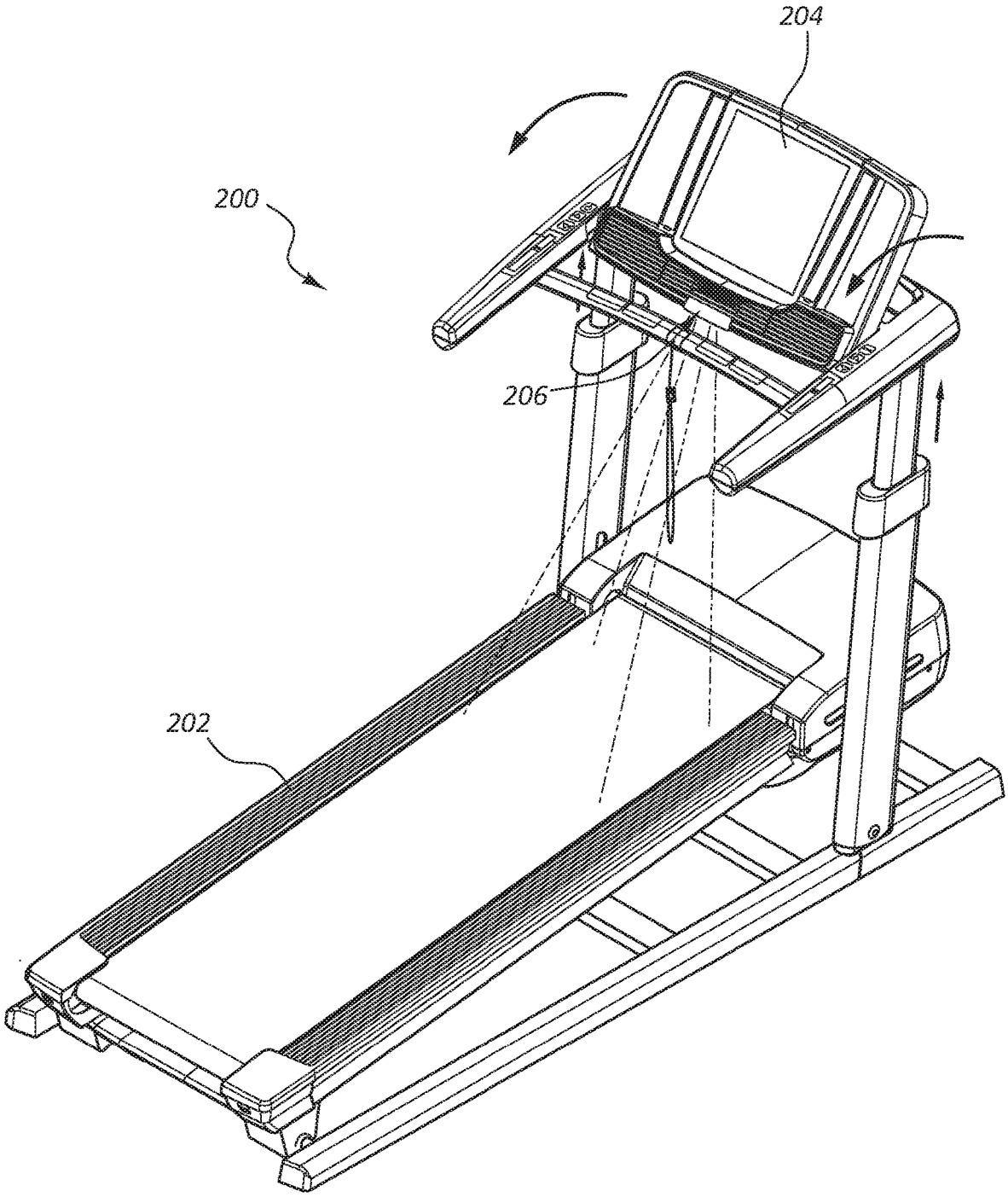
FIG. 2 illustrates a perspective view of an example of a treadmill in an inclined position in accordance with the present disclosure.

FIG. 2 depicts an example of a treadmill 200. In this example, the deck 202 is inclined so that the front portion of the deck 202 is elevated. The console 204 is also moved up and forward. In this example, the sensor 206 incorporated into the console 204 detects that the deck's distance from the console 204 changed. As a result, the sensor sends a signal to a processor to generate control signals to cause the console 204 to move a distance proportional to the distance that the deck 202 moved relative to the console 204.

Figure 3:
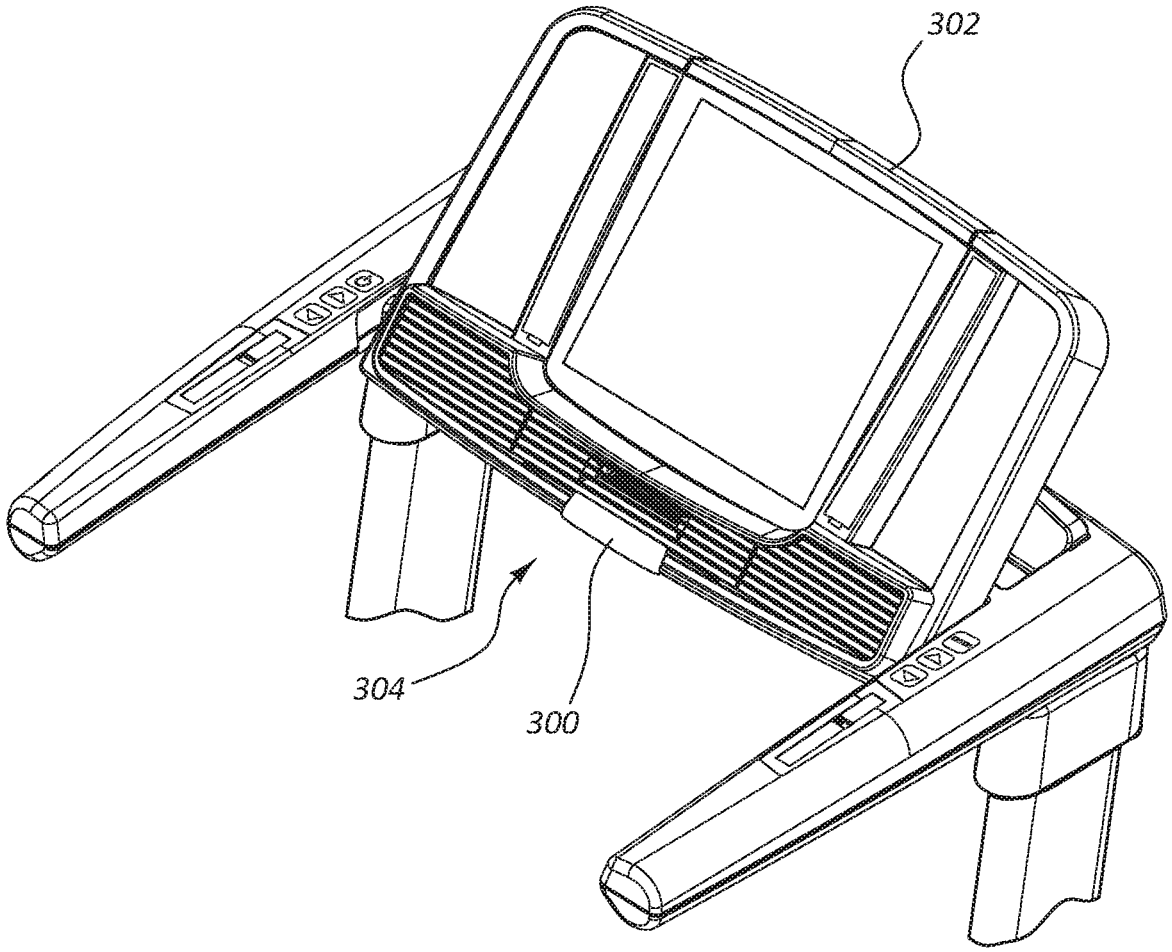
FIG. 3 illustrates a perspective view of an example of a sensor incorporated into a console in accordance with the present disclosure.

FIG. 3 depicts an example of a sensor 300 incorporated into a console 302 of a treadmill. In this example, the sensor 300 is secured to the underside 304 of the console 302. In some cases, the sensor 300 is a camera with an ability to send an optical or other signal towards the deck and measure the time that the reflection of the signal takes to return to the sensor 300. This time-of-flight measurement may be recorded by the sensor 300 and sent to a processor that sends directions to actuators to orient the console. In some cases, the processor causes the height of the console to change. In different examples, the processor causes the angle of the console to change. In yet other situations, the processor causes the forward position of the console to change. In an additional example, the processor causes the angle, forward position, and the height of the console 302 to change in response to the time-of-flight measurement.

Figure 4:
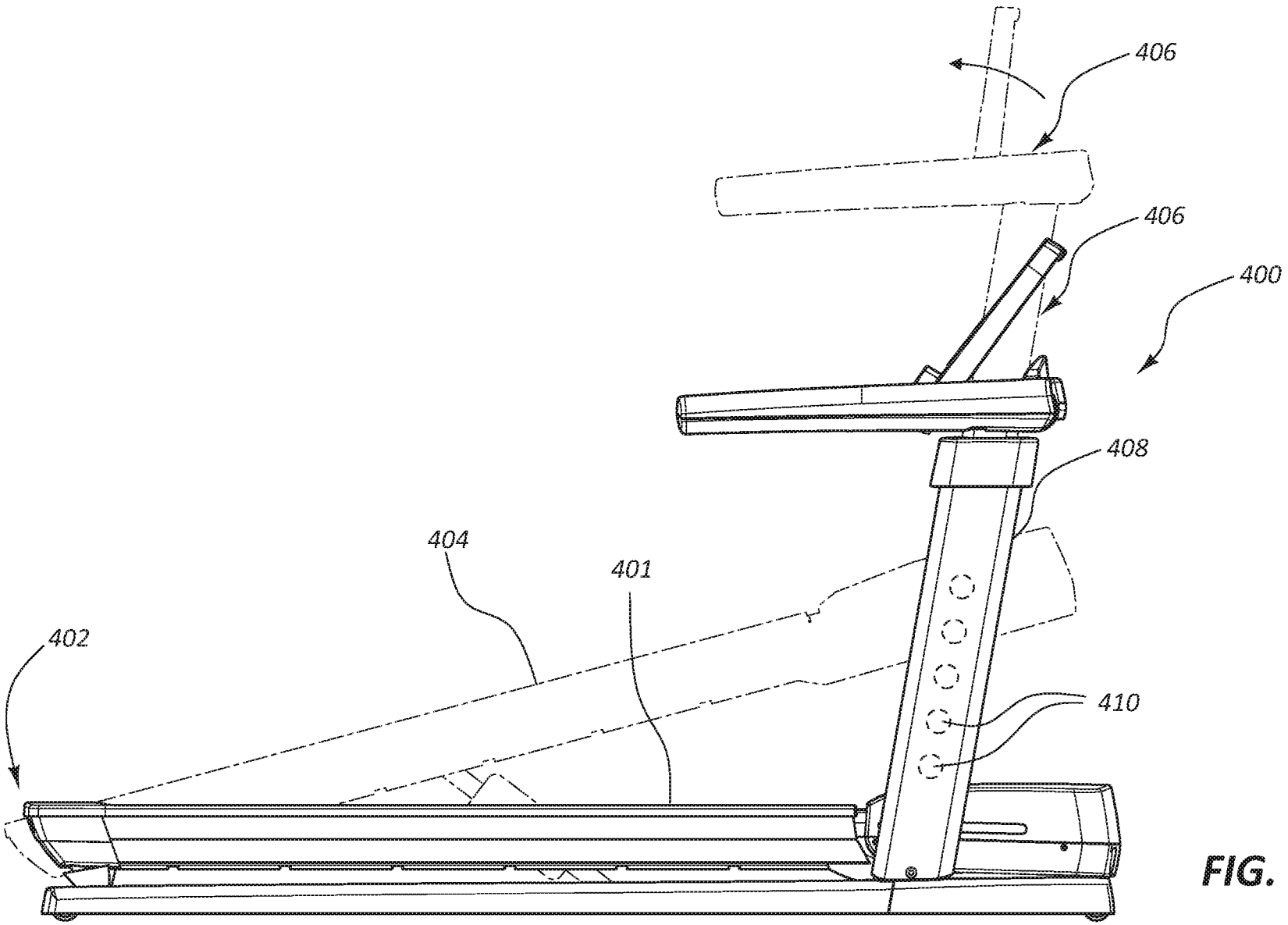
FIG. 4 illustrates a side view of an example of a treadmill in accordance with the present disclosure.

FIG. 4 depicts an example of a treadmill 400 from the side showing the deck 402 in a neutral position 401 in solid lines and showing the deck 402 in an inclined position 404 in dashed lines. The console 406 is moved forward and up when the deck 402 is in the inclined position verses when the deck 402 is in the neutral position.

In this example, at least one of the side posts 408 includes a series of magnetic sensors 410 that are located to sense the incline position of the deck 402. The side of the deck 402 may incorporate a least one magnet (not shown) so that when the deck is moved into a position that is adjacent to one of the magnetic sensors 410, the magnetic sensor 410 can have a signal strength that indicates that the deck 402 is positioned at an angle that is known to the processor. In response, the processor can send a signal to the actuators to change the console's position and orientation based on the deck's orientation.

Figure 5:
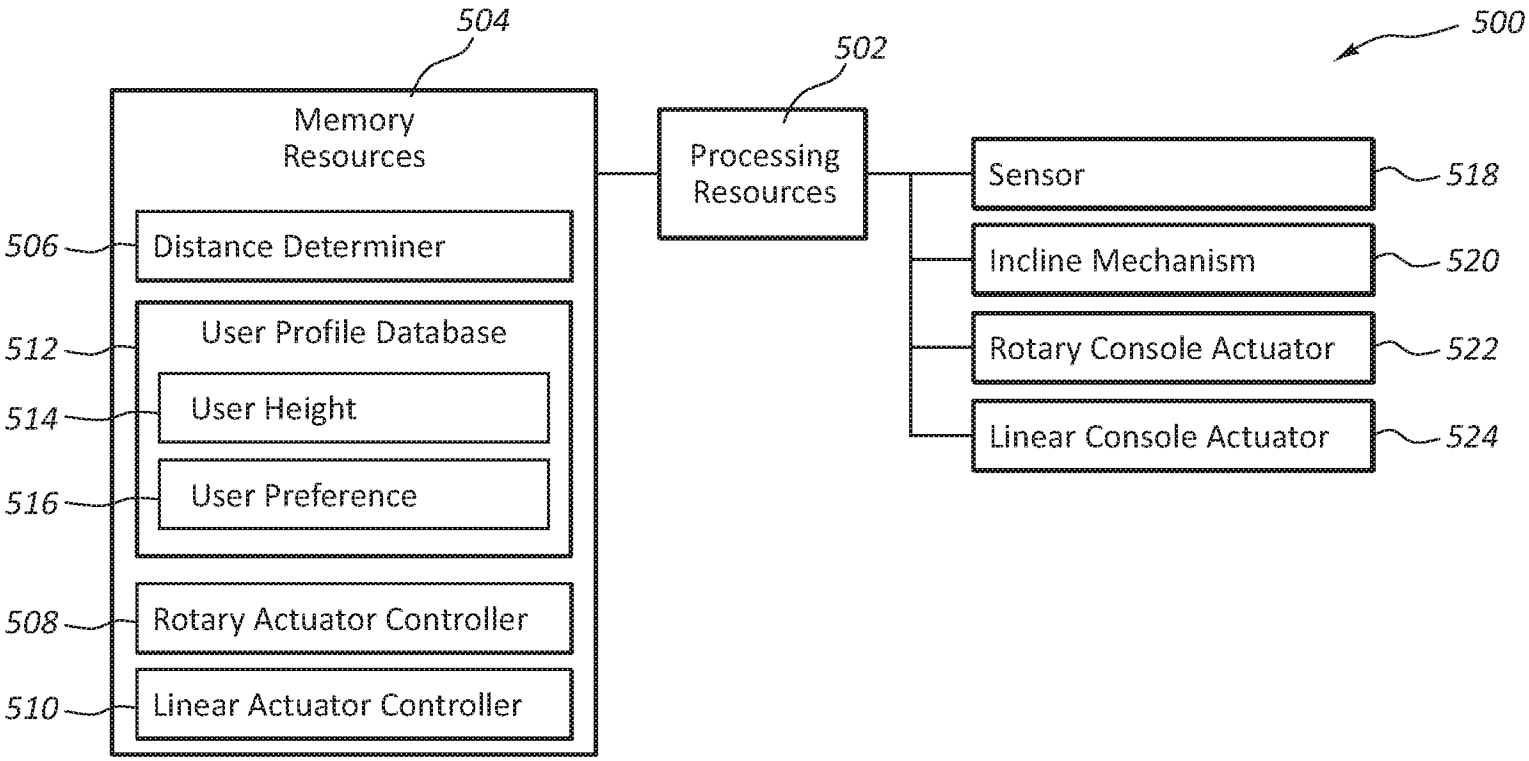
FIG. 5 illustrates a perspective view of an example of an adjusting system in accordance with the present disclosure.

FIG. 5 depicts an example of an adjusting system 500. In this example, the adjusting system 500 includes processing resources 502 and memory resources 504. The memory resources 504 may cause the processing resources 502 to carry out functions programmed in the memory resources 504. In this example, the memory resources 504 include a distance determiner 506, a user profile database 512 that includes a user height 514 and a user preference 516, a rotary actuator controller 508, and a linear actuator controller 510.

The processing resources 502 may be in communication with I/O resources, which may include a receiver, a transmitter, a transceiver, another type of communication device, or combinations thereof. Further, the processing resources 502 may be in direct communication or in communication through the I/O resources with a sensor 518, an incline mechanism 520, a rotary console actuator 522, and a linear console actuator 524.

Figure 6:
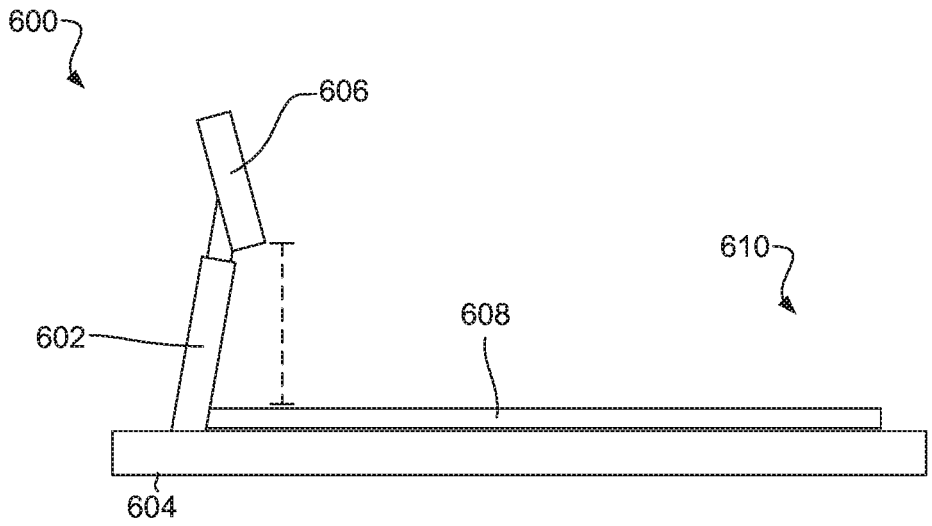
FIG. 6 illustrates a side view of an example of a treadmill in accordance with the present disclosure.

FIG. 6 depicts an example of a treadmill 600 with an upright portion 602 and a base 604. A console 606 is movably attached to the upright portion 602, and an exercise deck 608 is pivotally attached to the base 604 at a rear end 610. The console 606 is located at a correlated height based on the angle that is formed between the exercise deck 608 and the base 604.

Figure 7:
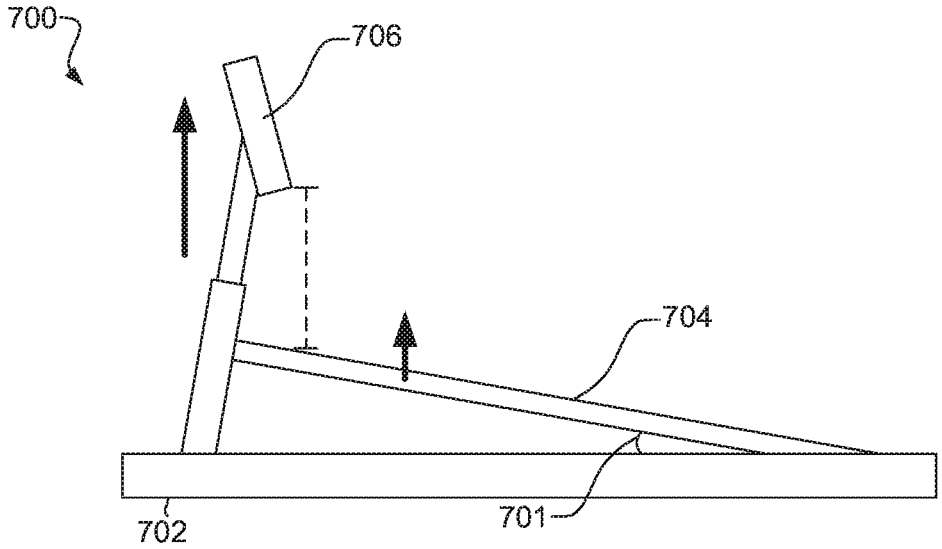
FIG. 7 illustrates a side view of an example of a treadmill in accordance with the present disclosure.

FIG. 7 depicts an example of a treadmill 700 with a greater angle 701 formed between the base 702 and the exercise deck 704. In this example, the console 706 is also located at a correlated height which is based at least in part on the angle of the exercise deck 704. In some cases, the correlated height is also based at least in part on at least one user preference.

Figure 8:
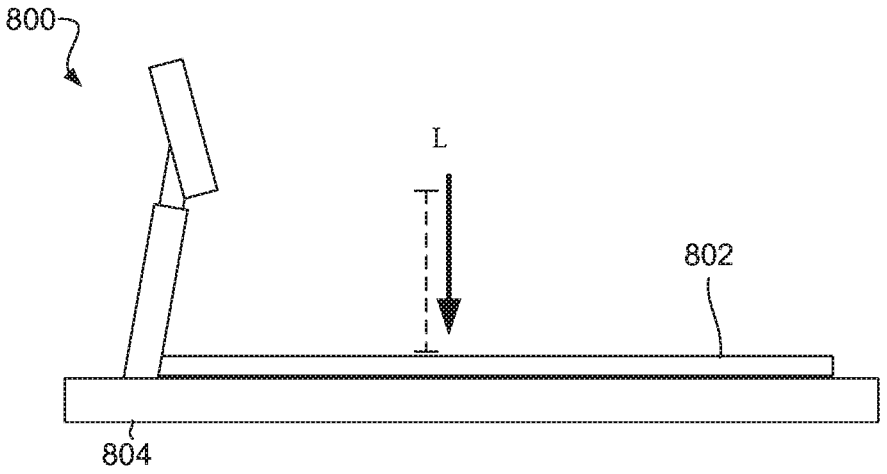
FIG. 8 illustrates a side view of an example of a treadmill in accordance with the present disclosure.

FIG. 8 depicts an example of a treadmill 800 where the angle between the exercise deck 802 and the base 804 is substantially zero. In this example, a load "L" is applied to a central portion of the exercise deck 802. This location may be where the user applies a load to the treadmill when the user is walking and/or running on the exercise deck during the performance of a workout. A console 806 is positioned at a correlated height based at least in part on the substantially zero angle and the location where the user is applying the load.

Figure 9:
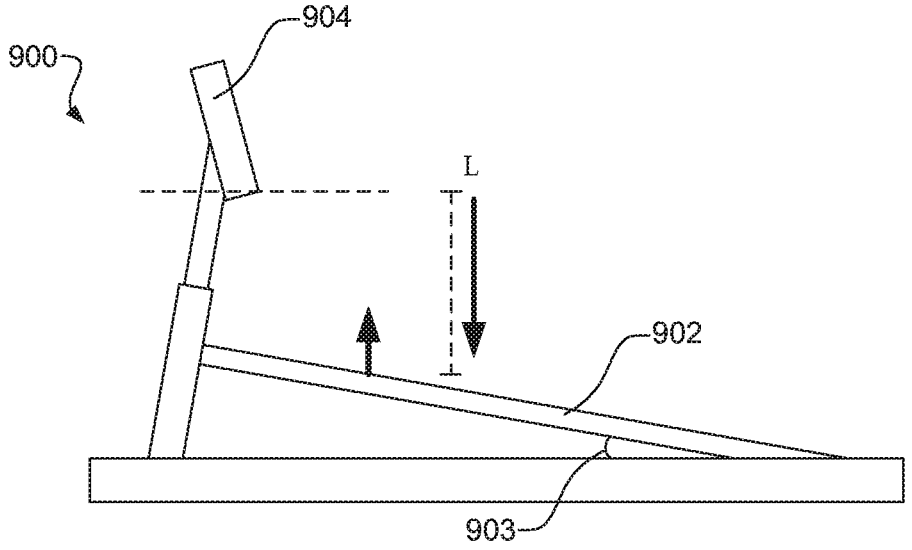
FIG. 9 illustrates a side view of an example of a treadmill in accordance with the present disclosure.

FIG. 9 depicts an example of a treadmill 900 with an elevated exercise deck 902 that forms an angle 903 substantially greater than zero. In this example, the console 904 is positioned at a correlated height that is determined at least in part on the substantially greater than zero angle and the location where the user is applying the load.

Figure 10:
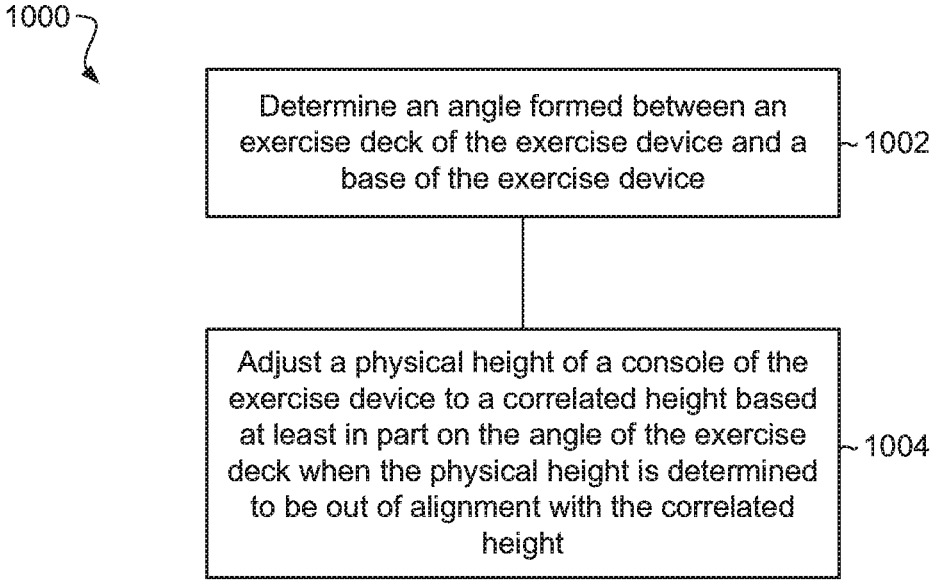
FIG. 10 illustrates a method of an example of positioning a console in accordance with the present disclosure.

FIG. 10 depicts an example of a method 1000 for positioning a console. In this example, the method 1000 includes determining 1002 an angle formed between an exercise deck of the exercise device and a base of the exercise device and adjusting 1004 a physical height of a console of the exercise device to a correlated height based at least in part on the angle of the exercise deck when the physical height is determined to be out of alignment with the correlated height.

Figure 11:
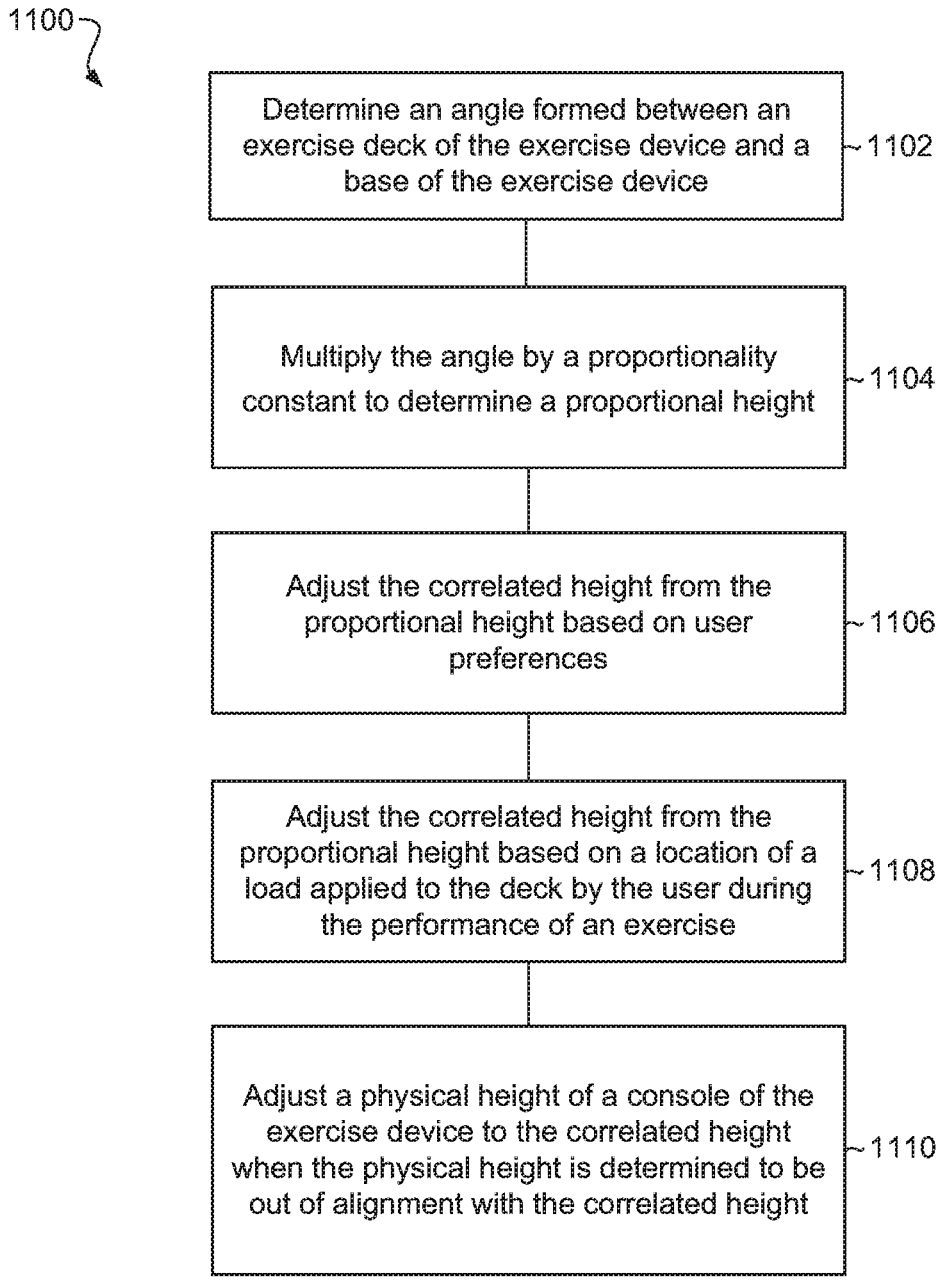
FIG. 11 illustrates a method of an example of positioning a console in accordance with the present disclosure.

FIG. 11 depicts an example of a method 1100 for positioning a console. In this example, the method 1100 includes determining 1102 an angle formed between an exercise deck of the exercise device and a base of the exercise device, multiplying 1004 the angle by a proportionality constant to determine a proportional height, adjusting 1106 the correlated height from the proportional height based on user preferences, adjusting 1108 the correlated height from the proportional height based on a location of a load applied to the deck by the user during the performance of an exercise, and adjusting 1110 a physical height of a console of the exercise device to a correlated height when the physical height is determined to be out of alignment with the correlated height.

General Description

In general, the invention disclosed herein may provide users with a treadmill that uses a method for moving a console based on the angle formed between the exercise deck and a base of the treadmill. The method may include determining a proportional angle, based at least in part on the angle. The correlated angle may be changed from the proportional angle based on the user's preferences, a location that the user applies a force on the exercise deck during the performance of an exercise, other factors, or combinations thereof.

The exercise deck may include a platform that has a first pulley located in a front portion of the deck and a second pulley located in a rear portion of the deck. A tread belt may surround the first and second pulleys and provide a surface on which the user may exercise. At least one of the first pulley and the second pulley may be connected to a motor so that when the motor is active, the pulley rotates. As the pulley rotates, the tread belt moves as well. The user may exercise by walking, running, or cycling on the tread belt's moving surface. In other examples, the tread belt is moved with the user's own power. In these situations, the tread belt may move as the user pushes off of the tread belt with his or her feet while walking or running A flywheel may be connected to the tread belt and/or one of the pulleys to maintain the tread belt's momentum under the user's power.

The exercise deck may be capable of having its front portion raised and lowered as well as its rear portion raised and lowered to control the lengthwise slope of the running deck. With these elevation controls, the orientation of the running deck can be adjusted as desired by the user or as instructed by a programmed workout. In those examples where the treadmill is involved with simulating a route that involves changes in elevation, the running deck can be oriented to mimic the elevation changes in the route while the user performs an exercise on the deck.

In one example, the lengthwise slope and/or lateral tilt angle of the exercise deck can be controlled with one or more actuators, often linear actuators, positioned at the corners of the deck. In another example, a single linear actuator positioned underneath the deck is attached to the deck's underside and a base of the deck. In this example, when the single linear actuator extends, the single linear actuator increases the incline angle of the deck and when the single linear actuator retracts, the single linear actuator decreases the incline angle of the deck. In yet other examples, multiple actuators are used to adjust the incline angle simultaneously. Other types of actuators may be used, such as cam surfaces, magnets, hydraulic actuators, pneumatic actuators, other types of actuators, or combinations thereof. Thus, in response to determining that the running deck's orientation should change, a signal can be sent to the actuators to appropriately move the deck into the desired orientation. The signal may come from the user's input, a simulated environment, a programmed workout, a remote device, another type of device or program, or combinations thereof.

The treadmill includes a console attached to an upright portion of the treadmill. In some cases, the upright portion includes a first post adjacent to a first side of the deck and a second post adjacent to a second side of the deck. In this example, the console is supported by the first and second deck. The deck moves independently of the first and second posts and also moves independently of the console.

The console may locate a display screen and the treadmill's controls within a convenient reach of the user to control the operating parameters of the exercise deck. For example, the console may include controls to adjust the speed of the tread belt, adjust a volume of a speaker integrated into the treadmill, adjust an incline angle of the running deck, adjust a decline of the running deck, adjust a lateral tilt of the running deck, select an exercise setting, control a timer, change a view on a display of the console, monitor the user's heart rate or other physiological parameters during the workout, perform other tasks, or combinations thereof. Buttons, levers, touch screens, voice commands, or other mechanisms may be incorporated into the console and can be used to control the capabilities mentioned above. Information relating to these functions may be presented to the user through the display. For example, a calorie count, a timer, a distance, a selected program, an incline angle, a decline angle, a lateral tilt angle, another type of information, or combinations thereof may be presented to the user through the display.

The treadmill may include preprogrammed workouts that simulate an outdoor route. In other examples, the treadmill has the capability of depicting a real world route. For example, the user may input instructions through the control console, a mobile device, another type of device, or combinations thereof to select a course from a map. This map may be a map of real world roads, mountain sides, hiking trails, beaches, golf courses, scenic destinations, other types of locations with real world routes, or combinations thereof. In response to the user's selection, the display of the control console may visually depict the beginning of the selected route. The user may observe details about the location, such as the route's terrain and scenery. In some examples, the display presents a video or a still frame taken of the selected area that represents how the route looked when the video was taken. In other examples, the video or still frame is modified in the display to account for changes to the route's location, such as real time weather, recent construction, and so forth. Further, the display may also add simulated features to the display, such as simulated vehicular traffic, simulated flora, simulated fauna, simulated spectators, simulated competitors, or other types of simulated features. While the various types of routes have been described as being presented through the display of the control console, the route may be presented through another type of display, such as a home entertainment system, a nearby television, a mobile device, another type of display, or combinations thereof.

In addition to simulating the route through a visual presentation of a display, the treadmill may also modify the orientation of the running deck to match the inclines and slopes of the route. For example, if the beginning of the simulated route is on an uphill slope, the running deck may be caused to alter its orientation to raise the front portion of the running deck. Likewise, if the beginning of the simulated route is on a downward slope, the rear portion of the running deck may be caused to elevate to simulate the decline in the route. Also, if the route has a lateral tilt angle, the running deck may be tilted laterally to the appropriate side of the running deck to mimic the lateral tilt angle.

While the programmed workout or the simulated environment may send control signals to orient the deck, the user may, in some instances, override these programmed control signals by manually inputting controls through the console. For example, if the programmed workout or the simulated environment cause the deck to be steeper than the user desires, the user can adjust the deck's orientation with the controls in the console.

Any appropriate type of actuator may be used in accordance with the principles described herein. For example, a non-exhaustive list of linear actuators that may be used includes screw actuators, hydraulic actuators, pneumatic actuators, solenoids, magnetic actuators, cams, electro-mechanical actuators, telescoping actuators, other types of linear actuators, other types of actuators, or combinations thereof. Further, the actuators may be powered with a motor, compressed gas, electricity, magnetic fields, other types power sources, or combinations thereof. Further, the actuators may also have the ability to laterally tilt the running deck to any appropriate angle formed between a running surface of the running deck and the surface upon which the treadmill rests. For example, the range of the lateral tilt angle may span from negative 55 degrees to positive 55 degrees, or any range there between.

In some examples, the treadmill includes a sensor that measures the distance that the deck is away from the console. This sensor may be in communication with a processor of the console adjusting system. This processor may also control actuators that move the console in response to determining that the distance between the console and the deck has changed. For example, in those situations where the sensor measures that the deck has been moved such that it is closer to the console than originally positioned, the actuators move the console farther away from the deck to maintain a predetermined distance between the deck and the console. Similarly, in those situations where the sensor measures that the deck is farther away from the console, the actuators move the console closer from the deck to maintain a predetermined distance between the deck and the console.

The console may be moved by any appropriate mechanism. In some examples, the console is moved with a vertical actuator. The vertical actuator may be positioned to move the console in a vertical direction. The vertical actuator may be a linear actuator or another type of actuator. Further, the vertical actuator may include a magnetic mechanism, a rack and pinion, a solenoid, a pneumatic mechanism, a hydraulic mechanism, another type of mechanism, or combinations thereof to cause the console to move. Likewise, the console may be moved with a horizontal actuator that is positioned to move the console in a horizontal direction. This horizontal actuator may be a linear actuator or another type of actuator as listed above.

Further, the console may be tilted into any appropriate orientation based on the position of the deck. In this example, the console may be pivotally connected to the upright portion. In some cases, as the incline angle of the deck increases, the console pivots forward so that the console maintains the same angular orientation relative to the user. Further, in some examples, when the incline angle decreases, the console pivots downward so that the console maintains the same angular orientation relative to the user.

In one example, the console is attached to a tray that is connected to the upright structure of the treadmill. In this example, the console can move along a track formed in the tray. In some examples, the tray can also pivot. In this example, the console can move with respect to the tray in a vertical direction and the tray can be rotated in response to the changes in the deck's incline angle.

In another example, the console may be connected to the upright portion through a track in the posts or another portion of the upright structure. In this example, the console is moved along the track in response to changes in the deck's incline angle. The movement along the track may be powered by a motor, a rack and pinion, a linear actuator, another type of actuator, or combinations thereof. The track may be a substantially straight track. In other examples, the track has at least a curved portion.

A distance sensor may be incorporated into the console which detects the distance that the deck is away from the console. In this example, the distance sensor may be a time-of-flight sensor that sends a signal towards the deck and measures the time for the signal's reflection to return to the sensor. The time-of-flight sensor may be an acoustic sensor, an infrared sensor, a radio frequency sensor, an ultrasonic sensor, a laser sensor, another type of sensor, or combinations thereof.

The distance sensor may be incorporated into any appropriate location of the treadmill. For example, the distance sensor may be incorporated into the underside of the console, the top side of the deck, an upright structure, a frame of the treadmill, another component of the treadmill, or combinations thereof. In some cases, the sensor is an integral feature of the treadmill. In yet other cases, the sensor is attachable to the outside of the treadmill.

The distance sensor may be continuously monitoring the distance between the console and the deck. In other examples, the distance sensor takes a measurement of the distance between the deck and the console at predetermined intervals. In yet other examples, the sensor takes a measurement when triggered by an appropriate event. An incline mechanism may send a signal to the processor when the incline mechanism is about to move, is currently moving, or has finished changing the incline angle of the deck. In response to receiving the signal from the incline mechanism, the processor can send instructions to the distance sensor to take a distance measurement. In response to determining the change in the distance, the processor can instruct the actuators that cause the console to move to make an adjustment.

In another example, the sensor is incorporated into the posts of the upright structure. As the front portion of the deck moves with respect to the posts based on the deck's incline angle, the sensor in the posts can determine the location of the deck and send the location information to the processor. For example, a series of magnetic sensors may be positioned along a portion of the posts' length. One of the magnetic sensors may be located in the neutral position so that the magnetic sensor senses that the deck is adjacent to the neutral magnetic sensor when the deck is in the neutral position. An object with a recognizable magnetic field may be incorporated into the deck so that the magnetic sensors can detect the presence of the deck when the deck is adjacent to the magnetic sensors. In one example, the object incorporated into the deck may be a magnet with a strong enough magnetic field strength that the magnetic sensor can detect the object's presence and therefore detect the presence of the deck. In another example, the object has an identifiable magnetic signature that allows the magnetic sensor to distinguish the presence of the object incorporated in the deck from other items that have a magnetic field.

In one situation, the deck may be inclined so that the front portion of the deck moves to be adjacent to a magnetic sensor located above the neutral sensor. In at least one instance, the deck may be moved so that the front portion of the deck is located adjacent to a third or fourth magnetic sensor that is located above the neutral magnet. In another example, the deck may be declined so that the magnetic sensors located below the neutral magnetic sensor detect that the front portion of the deck is located proximate to them. Depending on the location of the deck, one or more of the magnetic sensors may indicate that the deck is located proximate to the deck. While this example has been described with magnetic sensors incorporated into the upright structure to determine whether the front portion of the deck is adjacent, any appropriate type of sensor may be used. For example, the sensors incorporated into the upright structure may include optical sensors, time-of-flight sensors, push sensors, level sensors, other types of sensors, or combinations thereof.

In another example, the sensor is an optical sensor that may be incorporated into the console, incorporated into the upright structure of the console, incorporated into the deck, incorporated into another portion of the treadmill, or combinations thereof. The optical sensor may be positioned so that the deck is in the optical sensor's field of view. The optical sensor may include a position that the optical sensor understands to be a neutral baseline and when the deck is aligned with the neutral baseline, the optical sensor determines that the deck is in a neutral position. When the deck is angularly offset from the neutral baseline, the optical sensor can measure the angular offset to determine the deck's incline angle.

The console may move at the same time that the deck moves. In this example, the console is continuously adjusted in real time for the changes in the deck's incline angle. In other examples, the console moves after a delay after changing the deck's incline angle. In some situations, the console can be moved to one of multiple preset locations and/or preset angular orientations. In yet other situations, the console can be moved to any position or angular orientation within the ranges that the console can move.

The adjusting system for changing the position and/or orientation of the console may include a combination of hardware and programmed instructions for executing the functions of the adjusting system. The adjusting system may include processing resources that are in communication with memory resources. Processing resources include at least one processor and other resources used to process the programmed instructions. As described herein, the memory resources may represent generally any memory capable of storing data such as programmed instructions or data structures used by the adjusting system.

The processing resources may include I/O resources that are capable of being in communication with a remote device that stores the user information, user preferences, programmed workouts, simulated workouts, other types of information, or combinations thereof. The remote device may be a mobile device, a cloud based device, a computing device, another type of device, or combinations thereof. In some examples, the adjusting system communicates with the remote device through a mobile device which relays communications between the adjusting system and the remote device.

The remote device may execute a program that can provide useful information to the adjusting system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources include a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the actuation system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include a distance determiner that represents programmed instructions that, when executed, cause the processing resources to determine the distance that the console is from the deck. The distance determiner may determine the distance based on a measurement from the sensor. In another example, the adjusting system uses another mechanism for determining the distance of the deck from the console.

The memory resources may also include a profile user database that includes information about the user that affects the position and/or orientation of the console. In some examples, the profile user database includes a user height, a user preference, another characteristic about the user, or combinations thereof.

In some examples, the memory resources include a rotary actuator controller that represents programmed instructions that, when executed, cause a rotary console actuator to rotate the orientation of the console so that the console maintains a relative angle with the user despite a change in the deck's incline angle. Further, the memory resources may include a linear actuator controller that represents programmed instructions that, when executed, cause a linear console actuator to move the console in a linear direction based on the incline angle of the deck. In some cases, the linear direction includes a vertical direction, a horizontal direction, a diagonal direction, another type of direction, or combinations thereof.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, a mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

While the examples above have been described with reference to changing the position and/or orientation of the console based on the incline angle of the deck, any appropriate parameter of the deck may be used to trigger a change in the console's position and/or orientation. For example, changing the position and/or orientation of the console may be triggered by changing the side to side tilt of the deck, the overall height of the deck, another parameter of the deck, or combinations thereof.

In some cases, the incline mechanism sends instructions to the console to move the position and/or orientation of the console based on the changes in the deck's incline angle. In this situation, the sensor may confirm the distance between the deck and the console. In this type of example, the actuators that move the console may be triggered to move the console in response to receiving the confirmation.

The position of the console may change based on the angle of the deck, user preferences, the load applied to the deck, other factors, or combinations thereof. The correlated height of the console may be the desired height of the console for the user, which changes as the angle of the exercise deck changes. For example, when the angle between the exercise deck and the base is substantially zero, the correlated height of the console may be at an initial height ($H_i$). The $H_i$ may be measured relative to a support surface on which the treadmill is situated or measured relative to a front portion of the base, a front portion of the deck, another portion of the treadmill, or combinations thereof. When the angle changes, a proportionality constant ($C_p$) may be multiplied by the angle change ($\Delta\alpha$). The product of the $C_p$ and $\Delta\alpha$ can be used to modify $H_i$ to arrive at the correlated height ($H_c$). Thus, in this example, the correlated height may be represented by $$H_c=H_i+(C_p\times\Delta\alpha).$$

For example, if the initial height is 4.0 feet and the proportionality constant is 0.1, when the angle changes 1.0 degree, the correlated height becomes 4.1 feet. In this example, the correlated height equals a proportional height ($H_p$). In other words, $H_c=H_p$ in some instances. The proportionality constant ($C_p$) may be determined from a trigonometric relationship of the angle change ($\Delta\alpha$) and the relative change in height as determined by the length of the base times the tangent of the deck angle relative to the base.

In other examples, the correlated height may be affected by additional factors other than just the proportionality height. For example, the user's preferences ($P_u$) and where the user applies a load ($L_u$) onto the exercise deck during the performance of an exercise may be factors that make up the correlated height. In an example where the correlated height is affected by user preferences, the correlated height may be represented by $$H_c=H_p+P_u$$

In this example, if the user's preference is −0.2, and the proportional height is 4.1 feet as in the above example, then the correlated height is 3.9 feet.

In an example where the location of the user's load affects the correlated height, the correlated height may be represented as follows:

$$H_c=(H_p)-(L_u\times L_c)$$

In this representation, $L_c$ represents a location constant. In one example, the user's location may be 1.5 feet away from the console on the exercise deck. The location constant may be 0.05. Thus, in this example, product of the user's location and the location constant equals 0.075. Accordingly, the 0.075 is subtracted from the proportional height. In those examples where the proportional height is 4.1 feet, the correlated height in this case is 4.025 feet.

In some cases, both the user preferences and the user's location can be used to determine the correlated height. In one particular example, the correlated height may be represented as $$H_c=(H_p+P_u)-(L_u\times L_c)$$

Thus, in this example, the correlated height is determined by finding the proportional height and adjusting the proportional height with the user's preference. Then, the combination of the user's preference and the proportional height can be modified by the user's location. Keeping with the examples above where the proportional height is 4.1 feet, the user's preference is −0.2 feet, the user's location is 1.5, and the location constant is 0.05, then this representation of the correlated constant above equals 3.825 feet.

In yet another example, the user's location may be determined before the user's preference is applied. In one of these cases, the correlated height may be represented as $$H_c=(H_p-(L_u\times L_c))+P_u)$$

In keeping with the above examples where the proportional height is 4.1 feet, the user's preference is −0.2 feet, the user's location is 1.5, and the location constant is 0.05, then this representation of the correlated constant above also equals 3.825 feet.

While the examples above have been described with reference to a particular proportionality constant, any appropriate value for the proportionality constant may be used in accordance with the principles described herein. For example, the proportionality constant may include a value that is greater than −1.0 and less than 1.0.

While the examples above have been described with reference to a particular location constant, any appropriate value for the location constant may be used in accordance with the principles described herein. For example, the location constant may include a value that is greater than −1.0 and less than 1.0.

While the examples above have been described with reference to a particular initial height, any appropriate value for the initial height may be used in accordance with the principles described herein. For example, the initial height may include a value that is greater than 1.0 feet and less than 7.0 feet.

While the examples above have been described with reference to a particular user preference, any appropriate value for the user preference may be used in accordance with the principles described herein. For example, the user preference may include a value that is greater than −5.0 feet and less than 5.0 feet.

While the examples above have been described with reference to a particular user location, any appropriate value for the user location may be used in accordance with the principles described herein. For example, the user location may include a value that is greater than zero inches and less than a distance that equals a length of the exercise deck.

While the examples above have been described with reference to a particular angle formed between the base and the exercise deck, any appropriate value for the angle may be used in accordance with the principles described herein. For example, the angle may include a value that is greater than −25.0 degrees and less than 45.0 degrees.

Any appropriate trigger may initiate the process of adjusting the console to the correlated height. In some examples, the process is triggered when the incline mechanisms changes the angle of the exercise deck. In other examples, the process is triggered when the user sends a command to the treadmill to initiate the process. These types of commands may be sent to the treadmill through an input mechanism incorporated into the console, an input mechanism incorporated into a networked device, an input mechanism incorporated into a remote device, an input mechanism incorporated into another location on the treadmill, a speech command, a microphone, a button, a touchscreen, another type of input mechanism, or combinations thereof.

What is claimed is:

1. A method for positioning a console of an exercise device comprising a base, an exercise deck, at least one telescopic post and the console, wherein the exercise deck is adjustably attached to the base and the console is attached to the base through the at least one telescopic post, the method comprising:

determining an angle of the exercise deck of the exercise device, wherein the angle of the exercise deck is formed between the exercise deck and the base of the exercise device, and wherein the angle of the exercise deck is determined with a sensor incorporated into the console, the console and the exercise deck being supported by the base of the exercise device; and adjusting a physical height of the console of the exercise device to a correlated height based at least in part on the angle of the exercise deck.

2. The method of claim 1, further including determining the correlated height.

3. The method of claim 2, wherein determining the correlated height includes multiplying a change in the angle of the exercise deck by a proportionality constant to determine a proportional height.

4. The method of claim 3, wherein determining the correlated height further includes adjusting the correlated height based on the proportional height, the proportional height being based on user preferences.

5. The method of claim 3, wherein determining the correlated height further includes adjusting the correlated height based on the proportional height, the proportional height being based on a location of a load applied to the exercise deck by a user during a performance of an exercise.

6. The method of claim 1, wherein the correlated height is based in part on a location of a load applied to the exercise deck by a user during a performance of an exercise.

7. The method of claim 6, further including determining the location of the load applied by the user with at least one optical sensor.

8. The method of claim 6, further including determining the location of the load applied by the user with at least one load cell sensor.

9. The method of claim 1, wherein the correlated height is based in part on a user preference.

10. The method of claim 9, wherein the user preference is stored in a user profile.

11. The method of claim 1, wherein determining the angle of the exercise deck includes determining a height of at least of portion of the exercise deck with a distance sensor.

12. The method of claim 11, wherein the distance sensor is incorporated into the console.

13. The method of claim 1, wherein the correlated height has a proportional relationship with a change in the angle of the exercise deck.

14. The method of claim 1, wherein the determining the angle of the exercise deck occurs automatically in response to a change in an incline angle of the exercise deck.

15. A method for positioning a console of an exercise device comprising a base, an exercise deck, at least one telescopic post and the console, wherein the exercise deck is adjustably attached to the base and the console is attached to the base through the at least one telescopic post, the method comprising:

measuring a distance between the console and the exercise deck using a sensor incorporated into the console, the console and the exercise deck being supported by the base of the exercise device;

determining an angle of the exercise deck of the exercise device, wherein the angle of the exercise deck is formed between the exercise deck and the base of the exercise device, wherein the angle of the exercise deck is determined based on the distance between the console and the exercise deck; and adjusting a physical height of the console of the exercise device to a correlated height based at least in part on the angle of the exercise deck and a user preference.

16. The method of claim 15, wherein determining the correlated height includes multiplying a change in the angle of the exercise deck by a proportionality constant to determine a proportional height.

17. The method of claim 16, wherein determining the correlated height further includes adjusting the correlated height based on the proportional height, the proportional height being based on user preferences.

18. The method of claim 16, wherein determining the correlated height further includes adjusting the correlated height based on the proportional height based, the proportional height being based on a location of a load applied to the exercise deck by a user during a performance of an exercise.

19. The method of claim 15, wherein the determining the angle of the exercise deck occurs automatically in response to a change in an incline angle of the exercise deck.

20. A method for positioning a console of an exercise device comprising a base, an exercise deck, at least one telescopic post and the console, wherein the exercise deck is adjustably attached to the base and the console is attached to the base through the at least one telescopic post, the method comprising:

determining an angle of the exercise deck of the exercise device, wherein the angle of the exercise deck is formed between the exercise deck and the base of the exercise device in response to a change in an incline angle of the exercise deck, wherein the angle of the exercise deck is determined using a sensor incorporated into the console, the console and the exercise deck being supported by the base of the exercise device the exercise device;

multiplying a change in the angle of the exercise deck by a proportionality constant to determine a proportional height:

determining a correlated height from the proportional height based on at least one user preference and a location of a load applied to the exercise deck by a user during a performance of an exercise; and adjusting a physical height of the console of the exercise device to the correlated height based at least in part on the angle of the exercise deck and a user preference when the physical height is determined to be out of alignment with the correlated height.

* * * * *